US006040288A

United States Patent [19]

Popoff et al.

[11] Patent Number: 6,040,288

[45] Date of Patent: Mar. 21, 2000

[54] FABRIC COLOR PROTECTION COMPOSITIONS AND METHODS

[75] Inventors: Christine Popoff, Morganville; Alwyn Nartey, Plainsboro; Robert Gabriel, Cranbury, all of N.J.; Eric Aubay, Courbevoie, France

[73] Assignee: Rhodia Inc., Cranbury, N.J.

[21] Appl. No.: 09/026,828

[22] Filed: Feb. 20, 1998

Related U.S. Application Data

[60] Provisional application No. 60/038,299, Feb. 21, 1997, and provisional application No. 60/074,393, Feb. 11, 1998.

[51] Int. Cl.[7] ..... C11D 3/04; C11D 3/16

[52] U.S. Cl. ..... 510/466; 510/337; 510/323; 510/334; 510/446; 510/507

[58] Field of Search ..... 510/337, 323, 510/334, 446, 466, 507; 8/137, 137.5

[56] References Cited

U.S. PATENT DOCUMENTS

| | | | |
|---|---|---|---|
| 2,374,354 | 4/1945 | Kaplan | 260/309.6 |
| 2,524,218 | 10/1950 | Bersworth | 252/117 |
| 2,530,147 | 11/1950 | Bersworth | 260/404.5 |
| 2,874,074 | 2/1959 | Johnson | 117/139.5 |
| 3,033,704 | 5/1962 | Sherrill et al. | 117/47 |
| 3,244,724 | 4/1966 | Guttmann | 260/309.6 |
| 3,308,067 | 3/1967 | Diehl | 252/161 |
| 3,332,880 | 7/1967 | Kessler et al. | 252/161 |
| 3,681,241 | 8/1972 | Rudy | 252/8.75 |
| 3,717,630 | 2/1973 | Booth | 260/240 |
| 3,723,322 | 3/1973 | Diehl | 252/89 |
| 3,936,537 | 2/1976 | Baskerville, Jr. et al. | 427/242 |
| 4,127,489 | 11/1978 | Pracht et al. | 252/8.8 |
| 4,144,226 | 3/1979 | Crutchfield et al. | 528/231 |
| 4,146,495 | 3/1979 | Crutchfield et al. | 252/89 R |
| 4,483,779 | 11/1984 | Llenado et al. | 252/135 |
| 4,536,317 | 8/1985 | Llenado et al. | 252/174.17 |
| 4,536,318 | 8/1985 | Cook et al. | 252/174.17 |
| 4,536,319 | 8/1985 | Payne | 252/174.17 |
| 4,565,647 | 1/1986 | Llenado | 252/354 |
| 4,599,188 | 7/1986 | Llenado | 252/174.17 |
| 5,064,544 | 11/1991 | Lin et al. | 252/88 |
| 5,104,555 | 4/1992 | Foster et al. | 252/8.6 |
| 5,160,450 | 11/1992 | Okahara et al. | 252/174.21 |
| 5,173,201 | 12/1992 | Coffindaffer et al. | 252/8.8 |
| 5,236,615 | 8/1993 | Trinh et al. | 252/174.11 |
| 5,405,542 | 4/1995 | Trinh et al. | 252/8.8 |
| 5,510,042 | 4/1996 | Hartman et al. | 252/8.8 |
| 5,534,197 | 7/1996 | Scheibel et al. | 510/356 |

FOREIGN PATENT DOCUMENTS

| | | | |
|---|---|---|---|
| 0 150 867 | 8/1985 | European Pat. Off. | C11D 3/16 |
| 0 150 872 | 8/1985 | European Pat. Off. | C11D 3/16 |
| 0150872 | 8/1985 | European Pat. Off. . | |
| 0 300 525 | 1/1989 | European Pat. Off. | D05M 15/643 |
| 585 040 A1 | 3/1994 | European Pat. Off. | C11D 1/62 |
| 612 841 A2 | 8/1994 | European Pat. Off. | C11D 3/12 |
| 2 713 237 | 9/1995 | France | C11D 3/37 |
| 57-161170 | 3/1981 | Japan . | |
| 8067896 | 3/1996 | Japan | C11D 1/66 |
| 2 006 257 | 5/1979 | United Kingdom | C11D 3/60 |
| 92/07927 | 10/1991 | WIPO . | |
| WO 92/07927 | 5/1992 | WIPO | C11D 1/82 |
| WO 96/19194 | 6/1996 | WIPO | A61K 7/46 |
| WO 96/19562 | 6/1996 | WIPO | C11D 3/395 |

OTHER PUBLICATIONS

PCT Search Report in PCT application corresponding to U.S.Ser. No. 09/026,828.

*Primary Examiner*—Kery Fries

*Attorney, Agent, or Firm*—John Daniel Wood; Anthony P. Venturino

[57] ABSTRACT

Provided are methods of washing fabric articles in the presence of silicone oils to provide for color protection and/or fragrance retention in the washing of fabric articles with detergents. Fabric articles are washed in a washing medium comprised of a major amount by weight of water, a first minor amount by weight of a detergent and a second minor amount by weight of an aminosilicone having the formula:

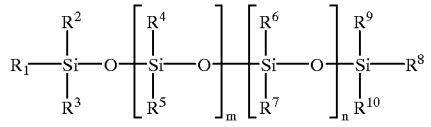

wherein: the variables are defined in the specification wherein said first minor amount by weight is greater than said second minor amount by weight. In preferred embodiments of this method, said washing medium is the product of mixing water with a composition comprised of said aminosilicone compound in association with an insoluble support. In particularly preferred embodiments, an aminosilicone compound wherein $R^1$ and $R^8$ are both alkoxy, (typically methoxy) is employed. Provided are powder detergent compositions, without inorganic phosphates, for washing textiles, in particular colored textiles, comprising:

at least one surface-active agent, at least one inorganic or organic builder which is soluble in the washing liquor, and at least one aminosilicone, said compositions not comprising more than 20% of their weight of inorganic substances which are insoluble in the washing liquor, and a process for protecting textiles, in particular colored textiles, by washing said textiles using an aqueous liquor containing said detergent compositions.

47 Claims, No Drawings

FABRIC COLOR PROTECTION COMPOSITIONS AND METHODS

CROSS REFERENCE TO RELATED APPLICATION

This application claims priority from U.S. Ser. No. 60/038,299 filed Feb. 21, 1997 and U.S. Ser. No. 60/074,393 filed Feb. 11, 1998 and entitled "Soluble Powder Detergent Compositions Without Inorganic Phosphates" in the names of Eric Aubay, Christine Popoff, Robert Gabriel and Alwyn Nartey.

FIELD OF THE INVENTION

The present invention relates to methods of washing fabric articles in the presence of silicone compounds to provide for color protection and/or fragrance retention in the washing of fabric articles with detergents. The present invention also relates to preferred compositions for use in the washing of fabric articles with detergents. Another subject of the present invention is powder detergent compositions, without inorganic phosphates, for washing textiles, in particular colored textiles, said compositions comprising at least one aminosilicone and being capable of forming a washing liquor which is free of or which only contains a small proportion of inorganic substances which are insoluble in said liquor. It is also targeted at a process for protecting textiles, in particular colored textiles, by washing the said textiles using an aqueous liquor containing said compositions.

BACKGROUND DISCUSSION

The use of various agents to soften fabrics is known in the art. For example, EP 585 040 A1 discloses a fabric softening composition comprising at least 1% by weight of a particular quaternary ammonium compound. EP 612 841 A2 discloses the use of a fabric softening clay on keratin containing fibers for controlling and for preventing pilling.

The use of certain silicone oils in detergent compositions to effect fabric softening and certain other benefits is disclosed e.g. in EP 150 872, EP 150 867 and FR 2 713 237. It is known (U.S. Pat. No. 4,585,563, WO 92/07927) to use aminosilicones in powder detergent compositions for washing laundry, in order to contribute advantages, such as softness, anti-static behavior, ease of ironing or resistance to creasing, to the fibers, in particular cotton fibers.

SUMMARY OF THE INVENTION

1. General Color Protection Method

In one aspect, this invention relates to a method comprising washing a colored fabric article in a washing medium comprised of a major amount by weight of water, a first minor amount by weight of a detergent and a second minor amount by weight of an aminosilicone compound having the formula:

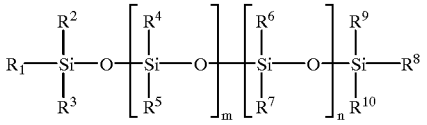

wherein:

$R^1$ and $R^8$ are independently selected from the group consisting of hydrogen, hydroxyl, alkyl (typically $C_1$–$C_4$) and alkoxy (typically $C_1$–$C_4$), $R^2$, $R^3$, $R^9$, and $R^{10}$ are independently selected from the group consisting of alkyl (typically $C_1$–$C_4$) and alkoxy (typically $C_1$–$C_4$), provided that one of $R^2$, $R^3$, $R^9$, and $R^{10}$ may be selected from the group consisting of a primary amino-substituted alkyl group, and a secondary amino-substituted alkyl group (typically an N-(amino-alkyl)-substituted aminoalkyl group such that the compound will have both primary and secondary amine functionality), $R^4$, $R^5$, and $R^6$ are independently selected from the group consisting of alkyl (typically $C_1$–$C_4$) and aryl (typically phenyl), $R^7$ is selected from the group consisting of a primary amino-substituted alkyl group, and a secondary amino-substituted alkyl group (typically an amino-alkyl-substituted alkyl group such that the compound will have both primary and secondary amine functionality), and m and n are numbers wherein m is greater than n (typically the ratio of m:n is from about 2:1 to about 500:1, more typically from about 40:1 to about 300:1 and most typically from about 85:1 to about 185:1) and the sum of n and m yield an aminosilicone compound with a viscosity of about 10 to about 100,000 cps at 25° C. (typically the sum of n and m is from about 5 to about 600, more typically from about 50 to about 400 and most typically from about 135 to about 275), wherein said first minor amount by weight is greater than said second minor amount by weight. In preferred embodiments of this method, said washing medium is the product of mixing water with a composition comprised of said aminosilicone compound in association with an insoluble support. In particularly preferred embodiments, an aminosilicone compound wherein $R^1$ and $R^8$ are both alkoxy, (typically methoxy) is employed. Preferably, the washing is repeated successively with at least about ten successive washing media. It has been found that the use of said washing medium is effective to prevent fading of the color of said fabric after said washings.

2. General Fragrance Retention Method

In another aspect, this invention relates to a method of washing a fabric article in a washing medium comprised of a major amount by eight of water, a first minor amount by weight of a detergent, a second minor amount by weight of an aminosilicone compound having the formula:

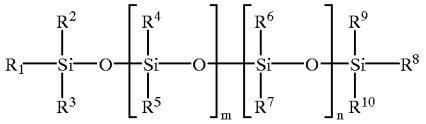

wherein:

$R^1$ and $R^8$ are independently selected from the group consisting of hydrogen, hydroxyl, alkyl (typically $C_1$–$C_4$) and alkoxy (typically $C_1$–$C_4$), $R^2$, $R^3$, $R^9$, and $R^{10}$ are independently selected from the group consisting of alkyl (typically $C_1$–$C_4$) and alkoxy (typically $C_1$–$C_4$), provided that one of $R^2$, $R^3$, $R^9$, and $R^{10}$ may be selected from the group consisting of a primary amino-substituted alkyl group, and a secondary amino-substituted alkyl group (typically an N-(amino-alkyl)-substituted aminoalkyl group such that the compound will have both primary and secondary amine functionality), $R^4$, $R^5$, and $R^6$ are independently selected from the group consisting of alkyl (typically $C_1$–$C_4$) and aryl (typically phenyl), $R^7$ is selected from the group consisting of a primary amino-substituted alkyl group, and a secondary amino-substituted alkyl group (typically an amino-alkyl-substituted alkyl group such that the compound will have both primary and secondary amine functionality), and m and n are numbers wherein m is greater than n (typically the ratio of m:n is from about 2:1 to about 500:1, more typically from about 40:1 to about 300:1 and most typically from about 85:1 to about 185:1) and the sum of n and m yield an aminosilicone compound with a viscosity of about 10 to about 100,000 cps at 25° C. (typically the sum of n and m is from about 5 to about 600, more typically from about 50 to about 400 and most typically from about 135 to about 275), and a third minor amount by weight of a fragrance, wherein said first minor amount by weight is greater than each of said second minor amount by weight and said third minor amount by weight. In preferred embodiments, said washing medium is the product of mixing water with a composition comprised of said aminosilicone compound in association with an insoluble support. In particularly preferred embodiments, an aminosilicone compound wherein $R^1$ and $R^8$ are both alkoxy is employed. It has been found that the use of said washing medium is effective to prolong the release of said fragrance from said fabric article after said washing.

3. General Detergent Composition with Insoluble Support

This invention also relates to a detergent composition comprising a major amount by weight of a detergent and a first minor amount by weight of an aminosilicone compound having the formula:

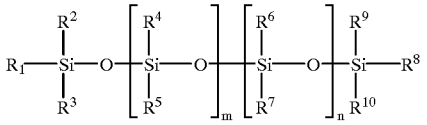

wherein:

$R^1$ and $R^8$ are independently alkoxy (typically $C_1$–$C_4$), $R^2$, $R^3$, $R^9$, and $R^{10}$ are independently selected from the group consisting of alkyl (typically $C_1$–$C_4$) and alkoxy (typically $C_1$–$C_4$), provided that one of $R^2$, $R^3$, $R^9$, and $R^{10}$ may be selected from the group consisting of a primary amino-substituted alkyl group, and a secondary amino-substituted alkyl group (typically an N-(amino-alkyl)-substituted aminoalkyl group such that the compound will have both primary and secondary amine functionality), $R^4$, $R^5$, and $R^6$ are independently selected from the group consisting of alkyl (typically $C_1$–$C_4$) and aryl (typically phenyl), $R^7$ is selected from the group consisting of a primary amino-substituted alkyl group, and a secondary amino-substituted alkyl group (typically an amino-alkyl-substituted alkyl group such that the compound will have both primary and secondary amine functionality), and m and n are numbers wherein m is greater than n (typically the ratio of m:n is from about 2:1 to about 500:1, more typically from about 40:1 to about 300:1 and most typically from about 85:1 to about 185:1) and the sum of n and m yield an aminosilicone compound with a viscosity of about 10 to about 100,000 cps at 25° (typically the sum of n and m is from about 5 to about 600, more typically from about 50 to about 400 and most typically from about 135 to about 275), and a second minor amount by weight of an insoluble support, wherein said aminosilicone compound is in association with said insoluble support.

4. General Color Protection Method with Insoluble Support

This invention further relates to a method comprising washing a fabric article in a washing medium comprised of a major amount by weight of water and a first minor amount by weight of a detergent, a second minor amount by weight of an aminosilicone compound having the formula:

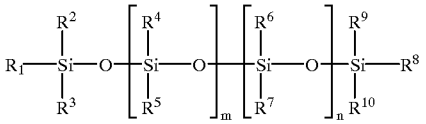

wherein:

$R^1$ and $R^8$ are independently selected from the group consisting of hydrogen, hydroxyl, alkyl (typically $C_1$–$C_4$) and alkoxy (typically $C_1$–$C_4$)

$R^2$, $R^3$, $R^9$, and $R^{10}$ are independently selected from the group consisting of alkyl (typically $C_1$–$C_4$), and alkoxy (typically $C_1$–$C_4$), provided that one of $R^2$, $R^3$, $R^9$, and $R^{10}$ may be selected from the group consisting of a primary amino-substituted alkyl group, and a secondary amino-substituted alkyl group (typically an N-(amino-alkyl)-substituted aminoalkyl group such that the compound will have both primary and secondary amine functionality), $R^4$, $R^5$, and $R^6$ are independently selected from the group consisting of alkyl (typically $C_1$–$C_4$) and aryl (typically phenyl), $R^7$ is selected from the group consisting of a primary amino-substituted alkyl group, and a secondary amino-substituted alkyl group typically an N-(amino-alkyl)-substituted aminoalkyl group such that the compound will have both primary and secondary amine functionality), and m and n are numbers wherein m is greater than n (typically the ratio of m:n is from about 2:1 to about 500:1, more typically from about 40:1 to about 300:1 and most typically from about 85:1 to about 185:1) and the sum of n and m yield an aminosilicone compound with a viscosity of about 10 to about 100,000 cps at 25° C. (typically the sum of n and m is from about 5 to about 600, more typically from about 50 to about 400 and most typically from about 135 to about 275), and a third minor amount by weight of an insoluble support, wherein said aminosilicone compound is in association with said insoluble support, wherein said first minor amount is greater than each of said second minor amount and said third minor amount. In certain preferred embodiments, said fabric article is a colored fabric article. In other preferred embodiments, said detergent composition is further comprised of a fragrance in a minor amount by weight, more typically about 0.05 to about 0.5%, more typically about 0.08 to about 0.12%.

5. Soluble Powder Detergent Compositions Without Inorganic Phosphates

Powder detergent compositions, without inorganic phosphates (alkali metal tripolyphosphates), contributing effective protection to textiles, in particular to colored textiles, have now been found.

According to a first subject of this invention, it concerns powder detergent compositions, without inorganic phosphates, comprising, at least one surface-active agent (S)

at least one inorganic or organic builder (B) which is soluble in the washing liquor and at least one aminosilicone (AS), said compositions not comprising more than 20% of their weight of inorganic substances which are insoluble in the washing liquor.

The builder is regarded as "soluble" when it is capable of dissolving to more than 80% of its weight in the washing liquor.

An inorganic substance is regarded as "insoluble" when its solubility is less than 20% of its weight in the washing liquor.

Washing liquor is understood to mean the liquor obtained by dilution of the detergent composition during the prewashing and/or washing cycle or cycles.

A second subject of this invention consists of a process for protecting textiles, in particular colored textiles, by washing said textiles using an aqueous liquor containing water and an effective amount of the said compositions containing an aminosilicone as defined above. The said aqueous liquor can contain of the order of 0.5 to 10 grams/litre of detergent composition containing an aminosilicone. It can relate to industrial or domestic washing operations, in a washing machine or by hand. The washing operations can be carried out at a temperature of the order of 25 to 90° C., preferably of 30 to 60° C.

DETAILED DESCRIPTION OF THE PREFERRED EMBODIMENTS

I. Aminoalkylalkoxysilane-silicone Compounds

One of the components of the compositions and methods of this invention is an aminosilicone compound of the formula:

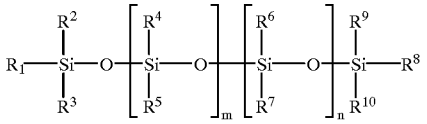

wherein:

$R^1$ and $R^8$ are independently selected from the group consisting of hydrogen, hydroxyl, alkyl (typically $C_1$–$C_4$) and alkoxy (typically $C_1$–$C_4$), $R^2$, $R^3$, $R^9$, and $R^{10}$ are independently selected from the group consisting of alkyl (typically $C_1$–$C_4$) and alkoxy (typically $C_1$–$C_4$), provided that one of $R^2$, $R^3$, $R^9$, and $R^{10}$ may be selected from the group consisting of a primary amino-substituted alkyl group, and a secondary amino-substituted alkyl group (typically an N-(amino-alkyl)-substituted aminoalkyl group such that the compound will have both primary and secondary amine functionality), $R^4$, $R^5$, and $R^6$ are independently selected from the group consisting of alkyl (typically $C_1$–$C_4$) and aryl (typically phenyl), $R^7$ is selected from the group consisting of a primary amino-substituted alkyl group, and a secondary amino-substituted alkyl group (typically an N-(aminoalkyl)-substituted aminoalkyl group such that the compound will have both primary and secondary amine functionality), m and n are numbers wherein m is greater than n (typically the ratio of m:n is from about 2:1 to about 500:1, more typically from about 40:1 to about 300:1 and most typically from about 85:1 to about 185:1) and the sum of n and m yield an aminosilicone compound with a viscosity of about 10 to about 100,000 cps at 25° (typically the sum of n and m is from about 5 to about 600, more typically from about 50 to about 400 and most typically from about 135 to about 275).

The preparation and properties of silicone compounds is discussed generally in *Silicones: Chemistry and Technology*, pp. 21–31 and 75–90 (CRC Press, Vulkan-Verlag, Essen, Germany, 1991) and in Harman et al. "Silicones"*Encyclopedia of Polymer Science and Engineering*, vol. 15, pp. (John Wiley & Sons, Inc. 1989), the disclosures of which are incorporated herein by reference. Preferred aminosilicone compounds are disclosed, for example in JP-047547 (J57161170) (Shinetsu Chem. Ind. KK). Particularly preferred aminosilicone compounds are the three of formula I wherein (1) $R^1$ and $R^8$ are methoxy, $R^2$, $R^3$, $R^4$, $R^5$, $R^6$, R9, and $R^{10}$ are methyl, $R^7$ is N-aminoethyl-3-aminopropyl, m is about 135, and n is about 1.5, (2) $R^1$ and $R^8$ are methoxy, $R^2$, $R^3$, $R^4$, $R^5$, $R^6$, $R^9$, and $R^{10}$ are methyl, $R^7$ is N-aminoethyl-3-aminopropyl, m is about 270, and n is about 1.5, and (3) $R^1$ and $R^8$ are ethoxy, $R^2$, $R^3$, $R^4$, $R^5$, $R^6$, $R^9$, and $R^{10}$ are methyl, $R^7$ is 3-aminopropyl, m is about 135, and n is about 1.5. Other aminosilicone compounds include those wherein $R^1$, $R^2$, and $R^8$ are ethoxy, $R^3$ is 3-aminopropyl, $R^4$, $R^5$, $R^6$, $R^9$, and $R^{10}$ are methyl, m is about 8, and n is zero. Of course, for pure aminosilicone compounds, the numbers m and n will be integers, but for mixtures of compounds, m and n will be expressed as fractions or compound numbers which represent an average of the compounds present. Further, the formula above is not meant to imply a block copolymer structure, thus, the aminosilicone compound may have a random or block structure. Typically, at least about 50% by weight of the $R^4$, $R^5$, and $R^6$ groups will be methyl groups, more typically at least about 90% and even more typically about 100%.

The aminosilicone compound typically will be in the form of a liquid or viscous oil at room temperature.

The aminosilicones described below in the context of the soluble powder detergent compositions can be substituted for the aminosilicones described above.

II. Insoluble Carriers

While the aminosilicone can be used in certain compositions and methods of this invention alone or as an aqueous emulsion, the aminosilicone is preferably used in association with a water-insoluble solid carrier, for example, clays, natural or synthetic silicates, silica, resins, waxes, starches, ground natural minerals, such as kaolins, clays, talc, chalk, quartz, attapulgite, montmorillonite, bentonite or diatomaceous earth, or ground synthetic minerals, such as silica, alumina, or silicates especially aluminum or magnesium silicates. Useful inorganic agents comprise those of natural or synthetic mineral origin. Specific examples of carriers include diatomaceous earths, e.g. Celite Registered TM (Johns Manville Corp., Denver, Colo.) and the smectite clays such as the saponites and the montmorillonite colloidal clays such as Veegum Registered TM and Van Gel Registered TM (Vanderbilt Minerals, Murray, Ky.), or Magnabrite Registered TM (American Colloid Co., Skokie, Ill.). Synthetic silicate carriers include the hydrous calcium silicate, Micro-Cel Registered TM and the hydrous magnesium silicate Celkate Registered TM (Seegot, Inc., Parsippany, N.J.). Inosilicates carriers such as the naturally-occurring calcium meta-silicates such as wollastonite, available as the NYAD Registered TM wollastonite series (Processed Minerals Inc., Willsboro, N.Y.) can also be mentioned. Synthetic sodium magnesium silicate clays, hectorite clays, and fumed silicas can also be mentioned as carriers. The carrier can be a very finely divided material of average particle diameter below 0.1 micron. Examples of such carriers are fumed silica and precipitated silica; these generally have a specific surface (BET) of above 40 $m^2/g$.

The clays that are particularly useful elements of the compositions and methods of this invention are those which cooperate with the silicone compounds to wash laundry better than would be expected from the actions of the individual components in detergent compositions. Such clays include the montmorillonite-containing clays which have swelling properties (in water) and which are of smectite structure. Typical of the smectite clays for use in the present invention is bentonite and typically the best of the bentonites are those which have a substantial swelling capability in water, such as the sodium bentonites, the potassium bentonites, or which are swellable in the presence of sodium or potassium ions, such as calcium bentonite. Such swelling bentonites are also known as western or Wyoming bentonites, which are essentially sodium bentonite. Other bentonites, such as calcium bentonite, are normally non-swelling. Among the preferred bentonites are those of sodium and potassium, which are normally swelling, and calcium and magnesium, which are normally non-swelling, but are swellable. Of these it is preferred to utilize calcium (with a source of sodium being present) and sodium bentonites. The bentonites employed are not limited to those produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Typically, the clay will have a high montmorillonite content and a low content of cristobalite and/or quartz. Also, other montmorillonite-containing smectite clays of properties like those of the bentonites described may be substituted in whole or in part for the bentonites described herein, but typically the clay will be a sodium bentonite with high montmorillonite content and low cristobalite and quartz contents.

The swellable bentonites and similarly operative clays are of ultimate particle sizes in the micron range, e.g., 0.01 to 20 microns and of actual particle sizes less than 100 or 150 microns, such as 40 to 150 microns or 45 to 105 microns. Such size ranges also apply to the zeolite builders, which will be described later herein. The bentonite and other such suitable swellable clays may be agglomerated to larger particle sizes too, such as up to 2 or 3 mm. in diameter.

The ratio of aminosilicone compound to carrier will typically range from about 0.001 to about 2, more typically from about 0.02 to about 0.5, and most typically from about 0.1 to about 0.3.

III. Detergents

The methods and compositions of this invention all employ a detergent, and optionally, other functional ingredients. Examples of the detergents and other functional ingredients that can be used are disclosed in U.S. Ser. No. 08/726,437, filed Oct. 4, 1996, the disclosure of which is incorporated herein by reference. The detergent can be selected from a wide variety of surface active agents.

A. Nonionic Surfactants

Nonionic surfactants, including those having an HLB of from 5 to 17, are well known in the detergency art. Examples of such surfactants are listed in U.S. Pat. No. 3,717,630, Booth, issued Feb. 20, 1973, and U.S. Pat. No. 3,332,880, Kessler et al., issued Jul. 25, 1967, each of which is incorporated herein by reference. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by Rhone-Poulenc Inc. and Triton X-45, X-114, X-100, and X-102, all marketed by Union Carbide.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants in this type include Tergitol 15-S-9, marketed by Union Carbide Corporation, Neodol 45-9, Neodol 23-6.5, Neodol 45-7, and Neodol 45-4, marketed by Shell Chemical Company.

(3) The condensation products of ethylene oxide with a hydrophobic base formed by the condensation of propylene oxide with propylene glycol. The hydrophobic portion of these compounds typically has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

(4) The condensation products of ethylene oxide with the product resulting from the reaction of propylene oxide and ethylenediamine. The hydrophobic moiety of these products consists of the reaction product of ethylenediamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

(5) Semi-polar nonionic detergent surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbons atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic detergent surfactants are the amine oxide detergent surfactants having the formula $$R^1(OR^2)_xNR_2^3 \rightarrow O$$

wherein $R^1$ is an alkyl, hydroxy alkyl, or alkyl phenyl group or mixtures thereof containing from about 8 to about 22 carbon atoms. $R^2$ is an alkylene or hydroxy alkylene group containing from 2 to 3 carbon atoms or mixtures thereof, x is from 0 to about 3 and each $R^3$ is an alkyl or hydroxy alkyl group containing from 1 to about 3 carbon atoms or a polyethylene oxide group containing from one to about 3 ethylene oxide groups and said $R^3$groups can be attached to each other, e.g., through an oxygen or nitrogen atom to form a ring structure.

Preferred amine oxide detergent surfactants are $C_{10}$–$C_{18}$ alkyl dimethyl amine oxide, $C_8$–$C_{18}$ alkyl dihydroxy ethyl amine oxide, and $C_{8-12}$ alkoxy ethyl dihydroxy ethyl amine oxide.

Nonionic detergent surfactants (1)–(4) are conventional ethoxylated nonionic detergent surfactants and mixtures thereof can be used.

Preferred alcohol ethoxylate nonionic surfactants for use in the compositions of the liquid, powder, and gel applications are biodegradable and have the formula $$R(OC_2H_4)_nOH$$

wherein R is a primary or secondary alkyl chain of from about 8 to about 22, preferably from about 10 to about 20 carbon atoms and n is an average of from about 2 to about 12, particularly from about 2 to about 9. The nonionics have an HLB (hydrophilic-lipophilic balance) of from about 5 to about 17, preferably from about 6 to about 15. HLB is defined in detail in Nonionic Surfactants, by M. J. Schick, Marcel Dekker, Inc., 1966, pages 606–613, incorporated herein by reference. In preferred nonionic surfactants, n is from 3 to 7. Primary linear alcohol ethoxylates (e.g., alcohol ethoxylates produced from organic alcohols which contain about 20% 2-methyl branched isomers, commercially available from Shell Chemical Company under the trademark Neodol) are preferred from a performance standpoint.

Particularly preferred nonionic surfactants for use in liquid, powder, and gel applications include the condensation product of $C_{10}$ alcohol with 3 moles of ethylene oxide; the condensation product of tallow alcohol with 9 moles of ethylene oxide; the condensation product of coconut alcohol with 5 moles of ethylene oxide; the condensation product of coconut alcohol with 6 moles of ethylene oxide; the condensation product of $C_{12}$ alcohol with 5 moles of ethylene oxide; the condensation product of $C_{12-13}$ alcohol with 6.5 moles of ethylene oxide, and th e same condensation product which is stripped so as to remove substantially all lower ethoxylate and nonethoxylated fractions; the condensation product of $C_{12-13}$ alcohol with 2.3 moles of ethylene oxide, and the same condensation product which is stripped so as to remove substantially all lower ethoxylated and nonethoxylated fractions; the condensation product of $C_{12-13}$ alcohol with 9 moles of ethylene oxide; the condensation product of $C_{14-15}$ alcohol with 2.25 moles of ethylene oxide; the condensation product of $C_{14-15}$s alcohol with 4 moles of ethylene oxide; the condensation product of $C_{14-15}$ alcohol with 7 moles of ethylene oxide; and the condensation product of $C_{14-15}$ alcohol with 9 moles of ethylene oxide. For bar soap applications, nonionic surfactants are preferably solids at room temperature with a melting point above about 25° C., preferably above about 30° C. Bar compositions of the present invention made with lower melting nonionic surfactants are generally too soft, not meeting the bar firmness requirements of the present invention.

Also, as the level of nonionic surfactant increases, i.e., above about 20% by weight of the surfactant, the bar can generally become oily.

Examples of nonionic surfactants usable herein, but not limited to bar applications, include fatty acid glycerine and polyglycerine esters, sorbitan sucrose fatty acid esters, polyoxyethylene alkyl and alkyl allyl ethers, polyoxyethylene lanolin alcohol, glycerine and polyoxyethylene glycerine fatty acid esters, polyoxyethylene propylene glycol and sorbitol fatty acid esters, polyoxyethylene lanolin, castor oil or hardened castor oil derivatives, polyoxyethylene fatty acid amides, polyoxyethylene alkyl amines, alkylpyrrolidone, glucamides, alkylpolyglucosides, and mono- and dialkanol amides.

Typical fatty acid glycerine and polyglycerine esters, as well as typical sorbitan sucrose fatty acid esters, fatty acid amides, and polyethylene oxide/polypropylene oxide block copolymers are disclosed by U.S. Pat. No. 5,510,042, Hartman et al, incorporated herein by reference.

The castor oil derivatives are typically ethoxylated castor oil. It is noted that other ethoxylated natural fats, oils or waxes are also suitable.

Polyoxyethylene fatty acid amides are made by ethoxylation of fatty acid amides with one or two moles of ethylene oxide or by condensing mono-or diethanol amines with fatty acid.

Polyoxyethylene alkyl amines include those of formula: $RNH—(CH_2CH_2O)_n—H$, wherein R is $C_6$ to $C_{22}$ alkyl and n is from 1 to about 100.

Monoalkanol amides include those of formula: $RCONHR^1OH$, wherein R is $C_6$–$C_{22}$ alkyl and $R^1$ is $C_1$ to $C_6$ alkylene. Dialkanol amides are typically mixtures of:

diethanolamide: $RCON(CH_2CH_2OH)_2$;

amide ester: $RCON(CH_2CH_2OH)—CH_2CH_2OOCR$;

amine ester: $RCOOCH_2CH_2NHCH_2CH_2OH$; and amine soap: $RCOOH_2N(CH_2CH_2OH)_2$, wherein R in the above formulas is an alkyl of from 6 to 22 carbon atoms.

Examples of preferred but not limiting surfactants for detergent bar products are the following:

Straight-Chain Primary Alcohol Alkoxylates

The deca-, undeca-, dodeca-, tetradeca-, and pentadeca-ethoxylates of n-hexadecanol, and n-hexadecanol, and n-octadecanol having an HLB within the range recited herein are useful nonionics in the context of this invention. Exemplary ethoxylated primary alcohols useful herein as the conventional nonionic surfactants of the compositions are n-$C_{18}$EO(10); n-$C_{14}$EO(13); and n-$C_{10}$EO(11). The ethoxylates of mixed natural or synthetic alcohols in the "tallow" chain length range are also useful herein. Specific examples of such materials include tallow-alcohol-EO(11), tallow-alcohol-EO(18), and tallow-alcohol-EO(25).

Straight-Chain Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful conventional nonionics in the context of this invention. Exemplary ethoxylated secondary alcohols useful herein are 2-$C_{16}$EO (11); 2-$C_{20}$EO(11); and 2-$C_{16}$EO(14).

Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as conventional nonionic surfactants in the instant compositions. The hexa-through octadeca-ethoxylates of p-tridecylphenol, m-pentadecylphenol, and the like, are useful herein. Exemplary ethoxylated alkylphenols useful in the mixtures herein are: p-tridecylphenol EO(11) and p-pentadecylphenol EO(18). Especially preferred is Nonyl Nonoxynol49 known as lgepal® DM-880 from Rhone-Poulenc Inc.

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately hereinabove can be ethoxylated to an HLB within the range recited herein and used as the conventional nonionic surfactants of the instant compositions.

Branched Chain Alkoxylates

Branched chain primary and secondary alcohols which are available can be ethoxylated and employed as conventional nonionic surfactants in compositions herein.

The above ethoxylated nonionic surfactants are useful in the present compositions alone or in combination, and the term "nonionic surfactant" encompasses mixed nonionic surface active agents.

Alkylpolysaccharides

Still further suitable nonionic surfactants of this invention include alkylpolysaccharides, preferably alkylpolyglycosides of the formula:

$$RO(C_nH_{2n}O)_t(Z)_x$$

wherein

Z is derived from glycose;

R is a hydrophobic group selected from the group consisting of a $C_{10}$–$C_{18}$, preferably a $C_{12}$–$C_{14}$, alkyl group, alkyl phenyl group, hydroxyalkyl group, hydroxyalkylphenyl group, and mixtures thereof;

n is 2 or 3; preferably 2;

t is from 0 to 10; preferably 0; and x is from 1.5 to 8; preferably 1.5 to 4; more preferably from 1.6 to 2.7.

These surfactants are disclosed in U.S. Pat. Nos. 4,565,647, Llenado, issued Jan. 21, 1986; 4,536,318, Cook et al., issued Aug. 20, 1985; 4,536,317, Llenado et al., issued Aug. 20, 1985; 4,599,188 Llenado, issued Jul. 8, 1986; and 4,536,319, Payne, issued Aug. 20, 1985; all of which are incorporated herein by reference.

The compositions of the present invention can also comprise mixtures of the above nonionic surfactants.

A thorough discussion of nonionic surfactants for detergent bar and liquid products is presented by U.S. Pat. Nos. 5,510,042, Hartman et al., and 4,483,779, Llenado, et al., incorporated herein by reference.

B. Anionic Surfactants

Anionic surfactants include any of the known hydrophobes attached to a carboxylate, sulfonate, sulfate or phosphate polar, solubilizing group including salts. Salts may be the sodium, potassium, ammonium and amine salts of such surfactants. Useful anionic surfactants can be organic sulfuric reaction products having in their molecular structure an alkyl group containing from about 8 to about 22 carbon atoms and a sulfonic acid or sulfuric acid ester group, or mixtures thereof. (Included in the term "alkyl" is the alkyl portion of acyl groups.) Examples of this group of synthetic detersive surfactants which can be used in the present invention are the alkyl sulfates, especially those obtained by sulfating the higher alcohols ($C_8$–$C_{18}$ carbon atoms) produced from the glycerides of tallow or coconut oil; and alkyl benzene sulfonates.

Other useful anionic surfactants herein include the esters of alpha-sulfonated fatty acids preferably containing from about 6 to 20 carbon atoms in the ester group; 2-acyloxyalkane-1-sulfonic acids preferably containing from about 2 to 9 carbon atoms in the acyl group and from about 9 to about 23 carbon atoms in the alkane moiety; alkyl ether sulfates preferably containing from about 10 to 20 carbon atoms in the alkyl group and from about 1 to 30 moles of ethylene oxide; olefin sulfonates preferably containing from about 12 to 24 carbon atoms; and beta-alkyloxy alkane sulfonates preferably containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein. Higher fatty acids containing from about 8 to about 24 carbon atoms and preferably from about 10 to about 20 carbon atoms and the coconut and tallow soaps can also be used herein as corrosion inhibitors.

Preferred water-soluble anionic organic surfactants herein include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; and olefin sulfonates containing from about 14 to 16 carbon atoms.

Specific preferred anionics for use herein include: the linear $C_{10}$–$C_{14}$ alkyl benzene sulfonates (LAS); the branched $C_{10}$–$C_{14}$ alkyl benzene sulfonates (ABS); the tallow alkyl sulfates, the coconut alkyl glyceryl ether sulfonates; the sulfated condensation products of mixed $C_{10}$–$C_{18}$ tallow alcohols with from about 1 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain non-interfering components which are processing by-products. For example, commercial alkaryl sulfonates, preferably $C_{10}$–$C_{14}$, can comprise alkyl benzene sulfonates, alkyl toluene sulfonates, alkyl naphthalene sulfonates and alkyl poly-benzenoid sulfonates. Such materials and mixtures thereof are fully contemplated for use herein.

Other examples of the anionic surfactants used herein include fatty acid soaps, ether carboxylic acids and salts thereof, alkane sulfonate salts, a-olefin sulfonate salts, sulfonate salts of higher fatty acid esters, higher alcohol sulfate ester or ether ester salts, alkyl, preferably higher alcohol phosphate ester and ether ester salts, and condensates of higher fatty acids and amino acids.

Fatty acid soaps include those having the formula: R-C(O)OM, wherein R is $C_6$ to $C_{22}$ alkyl and M is preferably sodium.

Salts of ether carboxylic acids and salts thereof include those having the formula: $R—(OR^1)_n—OCH_2C(O)OM$, wherein R is $C_6$ to $C_{22}$ alkyl, $R^1$ is $C_2$ to $C_{10}$, preferably $C_2$ alkyl, and M is preferably sodium.

Alkane sulfonate salts and a-olefin sulfonate salts have the formula: $R\text{-}SO_3M$, wherein R is $C_6$ to $C_{22}$ alkyl or a-olefin, respectively, and M is preferably sodium.

Sulfonate salts of higher fatty acid esters include those having the formula:

$$RC(O)O—R^1—SO_3M,$$

wherein R is $C_{12}$ to $C_{22}$ alkyl, $R^1$ is $C_1$ to $C_{18}$ alkyl and M is preferably sodium.

Higher alcohol sulfate ester salts include those having the formula: $RC(O)O—R^1—OSO_3M$, wherein R is $C_{12}$–$C_{22}$ alkyl, $R^1$ is $C_1$–$C_{18}$ hydroxyalkyl, M is preferably sodium.

Higher alcohol sulfate ether ester salts include those having the formula:

$$RC(O)(OCH_2CH_2)_x—R^1—OSO_3M,$$

wherein R is $C_{12}$–$C_{22}$ alkyl, $R^1$ is $C_1$–$C_{18}$ hydroxyalkyl, M is preferably sodium and x is an integer from 5 to 25.

Higher alcohol phosphate ester and ether ester salts include compounds of the formulas:

$$R—(OR^1)_n—OPO(OH)(OM);$$

$$(R—(OR^1)_n—O)_2PO(OM);$$

and $$(R—(OR^1)_n—O)_3—PO,$$

wherein R is alkyl or hydroxyalkyl of 12 to 22 carbon atoms, $R^1$ is $C_2H_4$, n is an integer from 5 to 25, and M is preferably sodium.

Other anionic surfactants herein are sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

C. Cationic Surfactants

Preferred cationic surfactants of the present invention are the reaction products of higher fatty acids with a polyamine selected from the group consisting of hydroxyalkylalkylenediamines and dialkylenetriamines and mixtures thereof.

A preferred component is a nitrogenous compound selected from the group consisting of:

(i) the reaction product mixtures of higher fatty acids with hydroxyalkylalkylenediamines in a molecular ratio of about 2:1, said reaction product containing a composition having a compound of the formula:

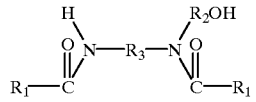

wherein $R_1$ is an acyclic aliphatic $C_{15}$–$C_{21}$, hydrocarbon group and $R_2$ and $R_3$ are divalent $C_1$–$C_3$ alkylene groups; commercially available as Mazamide 6 from PPG;

(ii) the reaction product of higher fatty acids with dialkylenetriamines in a molecular ratio of about 2:1; said reaction product containing a composition having a compound of the formula:

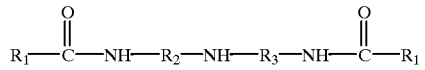

wherein $R_1$, $R_2$ and $R_3$ are as defined above; and mixtures thereof.

Another preferred component is a cationic nitrogenous salt containing one long chain acyclic aliphatic $C_{15}$–$C_{22}$ hydrocarbon group selected from the group consisting of:

(i) acyclic quaternary ammonium salts having the formula:

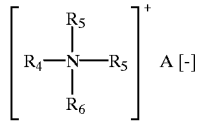

wherein $R_4$ is an acyclic aliphatic $C_{15}$–$C_{22}$ hydrocarbon group, $R_5$ and $R_6$ are $C_1$–$C_4$ saturated alkyl or hydroxyalkyl groups, and A [-] is an anion, especially as described in more detail hereinafter, examples of these surfactants are sold by Sherex Chemical Company under the Adgen trademarks;

(ii) substituted imidazolinium salts having the formula:

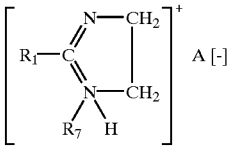

wherein $R_1$ is an acyclic aliphatic $C_{15}$–$C_{21}$, hydrocarbon group, $R_7$ is a hydrogen or a $C_1$–$C_4$ saturated alkyl or hydroxyalkyl group, and A [-] is an anion;

(iii) substituted imidazolinium salts having the formula:

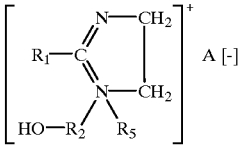

wherein $R_2$ is a divalent $C_1$–$C_3$ alkylene group and $R_1$, $R_5$ and A [-] are as defined above; an example of which is commercially available under the Monaquat ISIES trademark from Mona Industries, Inc.;

(iv) alkylpyridinium salts having the formula:

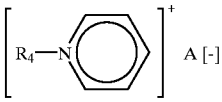

wherein $R_4$ is an acyclic aliphatic $C_{16}$–$C_{22}$ hydrocarbon group and A [-] is an anion; and (v) alkanamide alkylene pyridinium salts having the formula:

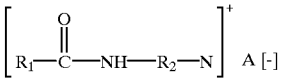

wherein $R_1$ is an acyclic aliphatic $C_{16}$–$C_{22}$ hydrocarbon group, $R_2$ is a divalent $C_1$–$C_3$ alkylene group, and A [-] is an ion group; and mixtures thereof.

Another class of preferred cationic nitrogenous salts having two or more long chain acyclic aliphatic $C_{15}$–$C_{22}$ hydrocarbon groups or one said group and an arylalkyl group are selected from the group consisting of:

(i) acyclic quaternary ammonium salts having the formula:

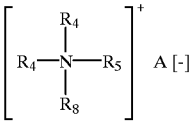

wherein each $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and A [-] is an anion defined as above; examples of which are commercially available from Sherex Company under the Adgen trademarks;

(ii) diamido quaternary ammonium salts having the formula:

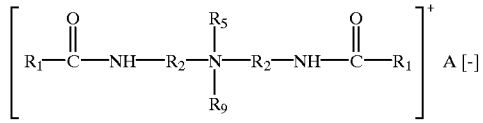

wherein each $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and A [-] is an anion; examples of which are sold by Sherex Chemical Company under the Varisoft trademark;

(iii) diamino alkoxylated quaternary ammonium salts having the formula:

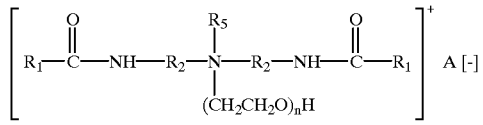

wherein n is equal to 1 to about 5, and $R_1$, $R_2$, $R_5$ and A [-] are as defined above;

(iv) quaternary ammonium compounds having the formula:

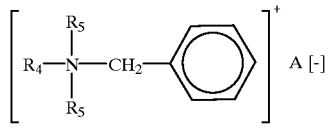

wherein each $R_4$ is an acyclic aliphatic $C_{15}$–$C_{22}$ hydrocarbon group, each $R_5$ is a $C_1$–$C_4$ saturated alkyl or hydroxyalkyl group, and A [-] is an anion; examples of such surfactants are available from Onyx Chemical Company under the Ammonyx® 490 trademark;

(v) substituted imidazolinium salts having the formula:

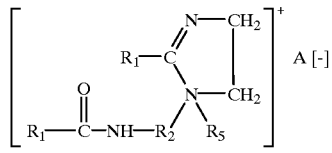

wherein each $R_1$ is an acyclic aliphatic $C_{15}$–$C_{21}$ hydrocarbon group, $R_2$ is a divalent alkylene group having 1 to 3 carbon atoms, and $R_5$ and A [-] are as defined above; examples are commercially available from Sherex Chemical Company under the Varisoft 475 and Varisoft 445 trademarks; and (vi) substituted imidazolinium salts having the formula:

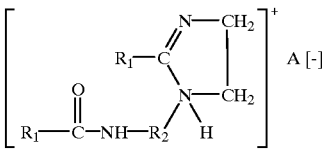

wherein $R_1$, $R_2$ and A - are as defined above; and mixtures thereof.

The more preferred cationic conventional surfactant is selected from the group consisting of an alkyltrimethylammonium salt, a dialkyldimethylammonium salt, an alkyldimethylbenzylammonium salt, an alkylpyridinium salt, an alkylisoquinolinium salt, benzethonium chloride, and an acylamino acid cationic surfactant.

Anion A

In the cationic nitrogenous salts herein, the anion A [-] provides electrical neutrality. Most often, the anion used to provide electrical neutrality in these salts is a halide, such as chloride, bromide, or iodide. However, other anions can be used, such as methylsulfate, ethylsulfate, acetate, formate, sulfate, carbonate, and the like. Chloride and methylsulfate are preferred herein as anion A.

Cationic surfactants are commonly employed as fabric softeners in compositions added during the rinse cycle of clothes washing. Many different types of fabric conditioning agents have been used in rinse cycle added fabric conditioning compositions as disclosed by U.S. Pat. No. 5,236,615, Trinh et al. and U.S. Pat. No. 5,405,542, Trinh et al., both patents herein incorporated by reference in their entirety. The most favored type of agent has been the quaternary ammonium compounds. Many such quaternary ammonium compounds are disclosed for example, by U.S. Pat. No. 5,510,042, Hartman et al. incorporated herein by reference in its entirety. These compounds may take the form of noncyclic quaternary ammonium salts having preferably two long chain alkyl groups attached to the nitrogen atoms. Additionally, imidazolinium salts have been used by themselves or in combination with other agents in the treatment of fabrics as disclosed by U.S. Pat. No. 4,127,489, Pracht, et al., incorporated herein by reference in its entirety. U.S. Pat. No. 2,874,074, Johnson discloses using imidazolinium salts to condition fabrics; and U.S. Pat. No. 3,681,241, Rudy, and U.S. Pat. No. 3,033,704, Sherrill et al. disclose fabric conditioning compositions containing mixtures of imidazolinium salts and other fabric conditioning agents. These patents are incorporated herein by reference in their entirety.

D. Amohoteric Surfactants

Amphoteric surfactants have a positive or negative charge or both on the hydrophilic part of the molecule in acidic or alkaline media.

Examples of the amphoteric surfactants which can be used herein include amino acid, betaine, sultaine, phosphobetaines, imidazolinium derivatives, soybean phospholipids, and yolk lecithin. Examples of suitable amphoteric surfactants include the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates and alkyl amphopropionates wherein alkyl represents an alkyl group having 6 to 20 carbon atoms. Other suitable amphoteric surfactants include alkyliminopropionates, alkyl iminodipropionates and alkyl amphopropylsulfonates having between 12 and 18 carbon atoms, alkylbetaines and amidopropylbetaines and alkylsultaines and alkylamidopropylhydroxy sultaines wherein alkyl represents an alkyl group having 6 to 20 carbon atoms are especially preferred.

Particularly useful amphoteric surfactants include both mono and dicarboxylates such as those of the formulae:

(A)

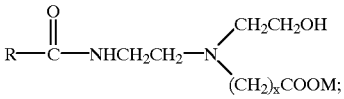

(B)

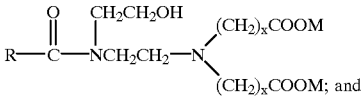

(C)

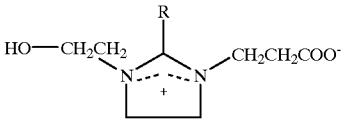

wherein R is an alkyl group of 6–20 carbon atoms, x is 1 or 2 and M is hydrogen or sodium. Mixtures of the above structures are particularly preferred.

Other formulae for the above amphoteric surfactants include the following:

(D)

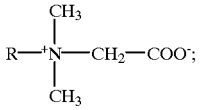

Alkyl betaines (E)

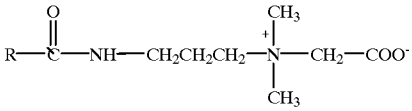

Amidopropyl betaines (F)

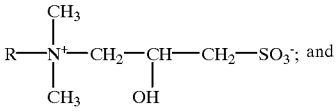

Alkyl sultaines (G)

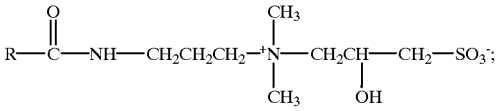

Alkyl amidopropylhydroxy sultaines where R is an alkyl group of 6–20 carbon atoms and M is hydrogen or sodium.

Of the above amphoteric surfactants, particularly preferred are the alkali salts of alkyl amphocarboxyglycinates and alkyl amphocarboxypropionates, alkyl amphodipropionates, alkyl amphodiacetates, alkyl amphoglycinates, alkyl amphopropyl sulfonates and alkyl amphopropionates wherein alkyl represents an alkyl group having 6 to 20 carbon atoms. Even more preferred are compounds wherein the alkyl group is derived from coconut oil or is a lauryl group, for example, cocoamphodipropionate. Such cocoamphodipropionate surfactants are commercially sold under the trademarks Miranol C2M-SF CONC. and Miranol FBS by Rhone-Poulenc Inc.

Other commercially useful amphoteric surfactants are available from Rhone-Poulenc Inc. and include:

| |
|---|
| cocoamphoacetate (sold under the trademarks MIRANOL CM CONC. and MIRAPON FA), |
| cocoamphopropionate (sold under the trademarks MIRANOL CM-SF CONC. and MIRAPON FAS), |
| cocoamphodiacetate (sold under the trademarks MIRANOL C2M CONC. and MIRAPON FB), |
| lauroamphoacetate (sold under the trademarks MIRANOL HM CONC. and MIRAPON LA), |
| lauroamphodiacetate (sold under the trademarks MIRANOL H2M CONC. and MIRAPON LB), |
| lauroamphodipropionate (sold under the trademarks MIRANOL H2M SF CONC. AND MIRAPON LBS), |
| lauroamphodiacetate obtained from a mixture of lauric and myristic acids (sold under the trademark MIRANOL BM CONC.), and |
| cocoamphopropyl sulfonate (sold under the trademark MIRANOL CS CONC.) |

Somewhat less preferred are:

| |
|---|
| caproamphodiacetate (sold under the trademark MIRANOL S2M CONC.), |
| caproamphoacetate (sold under the trademark MIRANOL SM CONC.), |
| caproamphodipropionate (sold under the trademark MIRANOL S2M-SF CONC.), and |
| stearoamphoacetate (sold under the trademark MIRANOL DM). |

E. Gemini Surfactants

Gemini surfactants form a special class of surfactant. These surfactants have the general formula:

$$A—G—A^1$$

and get their name because they comprise two surfactant moieties ($A,A^1$) joined by a spacer (G), wherein each surfactant moiety ($A,A,^1$) has a hydrophilic group and a hydrophobic group. Generally, the two surfactant moieties ($A,A^1$) are twins, but they can be different.

The gemini surfactants are advantageous because they have low critical micelle concentrations (cmc) and, thus, lower the cmc of solutions containing both a gemini surfactant and a conventional surfactant. Lower cmc causes better solubilization and increased detergency at lower surfactant use levels and unexpectedly enhances the deposition of the soil release polymers as claimed by this invention with demonstrated results to follow herein. Soil removal agents adhere to the fabric being laundered, much better than when mixed with only non-gemini, conventional surfactants.

Also, the gemini surfactants result in a low $pC_{20}$ value and low Krafft points. The $pC_{20}$ value is a measure of the surfactant concentration in the solution phase that will reduce the surface tension of the solvent by 20 dynes/cm. It is a measure of the tendency of the surfactant to adsorb at the surface of the solution. The Krafft point is the temperature at which the surfactant's solubility equals the cmc. Low Krafft points imply better solubility in water, and lead to greater latitude in making formulations.

A number of the gemini surfactants are reported in the literature, see for example, Okahara et al., J. Japan Oil Chem. Soc. 746 (Yukagaku) (1989); Zhu et al., 67 JAOCS 7,459 (July 1990); Zhu et al., 68 JAOCS 7,539 (1991); Menger et al., J. Am. Chemical Soc. 113, 1451 (1991); Masuyama et al., 41 J. Japan Chem. Soc. 4,301 (1992); Zhu et al., 69 JAOCS 1,30 (Jan. 1992); Zhu et al., 69 JAOCS 7,626 July 1992); Menger et al., 115 J. Am. Chem. Soc. 2, 10083 (1993); Rosen, Chemtech 30 (March 1993); and Gao et al., 71 JAOCS 7,771 (July 1994), all of this literature incorporated herein by reference.

Also, gemini surfactants are disclosed by U.S. Pat. Nos. 2,374,354, Kaplan; 2,524,218, Bersworth; 2,530,147 Bersworth (two hydrophobic tails and three hydrophilic heads); 3,244,724, Guttmann; 5,160,450, Okahara, et al., all of which are incorporated herein by reference.

The gemini surfactants may be anionic, nonionic, cationic or amphoteric. The hydrophilic and hydrophobic groups of each surfactant moiety ($A,A^1$) may be any of those known to be used in conventional surfactants having one hydrophilic group and one hydrophobic group.

For example, a typical nonionic gemini surfactant, e.g., a bis-polyoxyethylene alkyl ether, would contain two polyoxyethylene alkyl ether moieties.

Each moiety would contain a hydrophilic group, e.g., polyethylene oxide, and a hydrophobic group, e.g., an alkyl chain.

Gemini surfactants specifically useful in the present invention include gemini anionic or nonionic surfactants of the formulae:

II

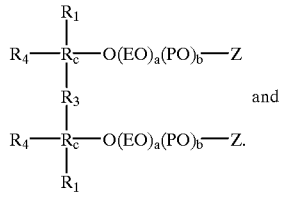

and

III

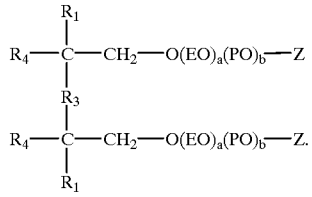

wherein $R_c$ represents aryl, preferably phenyl.

$R_1$, $R_3$, $R_4$, Y, Z, a and b are as defined above.

More specifically, these compounds comprise:

IV

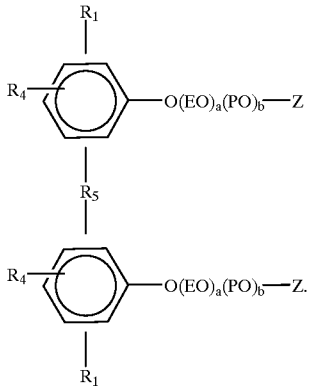

V

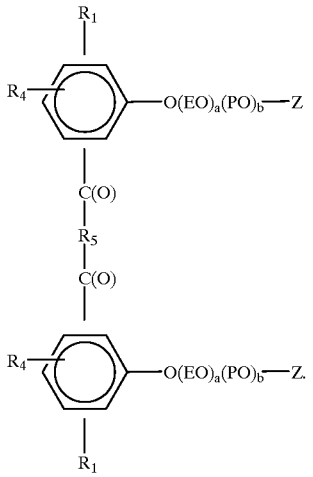

VI

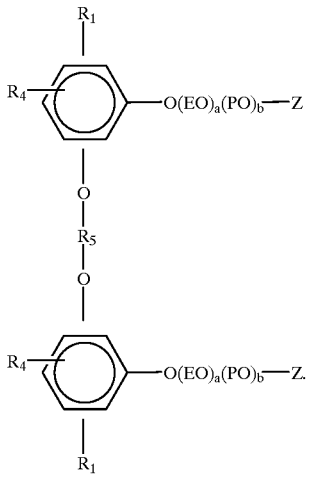

wherein $R_1$, $R_4$, $R_5$, Z, a, and b are as defined hereinbefore.

The primary hydroxyl group of these surfactants can be readily phosphated, sulfated or carboxylated by standard techniques.

The compounds included in Formula II can be prepared by a variety of synthetic routes. For instance, the compounds of Formula IV can be prepared by condensing a monoalkyl phenol with paraformaldehyde in the presence of an acid catalyst such as acetic acid. The compounds of Formula V can be synthesized by a Lewis acid catalyzed reaction of an alkylphenol with a dicarboxylic acid, e.g., terephthalic acid.

The compounds of Formula II are more fully described in copending application U.S. Ser. No. 60/009,075 filed Dec. 21, 1995, the entire disclosure of which is incorporated herein by reference.

A class of gemini surfactants that can be used in providing the improved emulsions which are operable at lower concentrations as disclosed in the present invention include a group of amphoteric, and cationic quaternary surfactants comprising compounds of the formula:

VII.

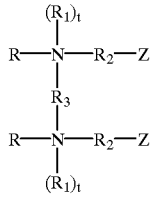

wherein R, t, and Z are as defined hereinbefore. $R_1$ is as defined before and includes the $[—(EO)_a(PO)_bO—]H$ moiety. $R_2$ is as defined before, however, D includes the following moieties: $—N(R_6)—C(O)—R_5—CH_2O—$ and $—N(R_6)—C(O)—R_5—N(R_6)—R_4—$. When t is zero, the compounds are amphoteric and when t is 1, the compounds are cationic quaternary compounds. $R_3$ is selected from the group consisting of a bond, $C_1$–$C_{10}$ alkyl, and $—R_8—D_1—R_8—$ wherein $D_1$, $R_5$, $R_6$, a, b, and $R_8$ are as defined above (except $R_8$ is not $—OR_5O—$).

Preferably, the compounds of Formula VII comprise:

VIII.

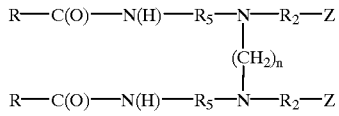

wherein R, $R_2$, $R_5$ and Z are as defined above and n equals a number from about 2 to about 10. More particularly, the compounds of Formula VII comprise:

IX

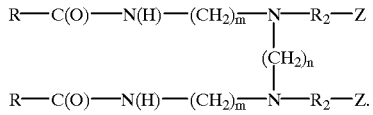

wherein R, $R_2$, $R_5$, Z, and n are as defined hereinbefore; and m independently equals a number between about 2 and about 10.

Representative compounds of Formula VII include:

X.

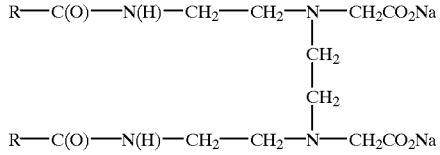

-continued

XI.

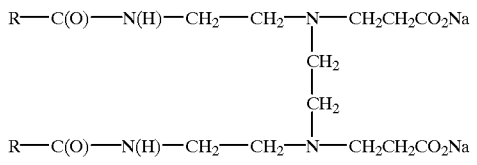

XII.

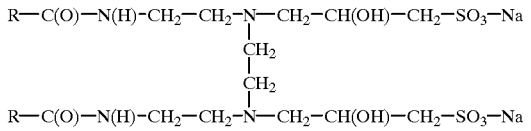

While the compounds of Formulae VII–XII can be prepared by a variety of synthetic routes, it has been found that they can be produced particularly effectively by a process which utilizes a polyamine reactant having at least four amino groups of which two are terminal primary amines such as triethylene tetramine. These processes are more fully set forth in copending application "Amphoteric Surfactants Having Multiple Hydrophobic and Hydrophilic Groups", U.S. Ser. No. 08/292,993 filed Aug. 19, 1994, the entire disclosure of which is incorporated herein by reference.

Another group of gemini surfactants which have been found to provide the low concentration emulsions of this invention are the cyclic cationic quaternary surfactants of the formula:

XIII.

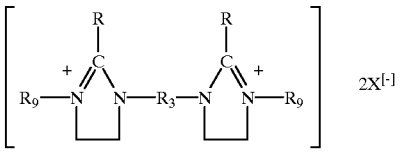

wherein R and $R_3$ are as identified hereinbefore in formula VII; $R_9$ is independently a $C_1$–$C_{10}$ alkyl or alkylaryl; and X represents a counterion such as an anion illustrated by halogen (C1, Br, and I), alkylsulfate such as methyl or ethylsulfate, alkylphosphate such as methylphosphate, and the like.

Preferably, the compounds used in the present invention comprise those of Formula XIII in which $R_3$ is a $C_2$–$C_4$ alkyl, most preferably ethyl, $R_9$ is a lower alkyl of from 1 to about 4 carbon atoms, most preferably methyl; and X is halogen or methylsulfate.

The compounds of Formula XIII can be prepared by a variety of snythetic routes though it has been found that they can be produced particularly effectively by quaternizing a bisimidazoline prepared by a process disclosed and claimed in copending application "Amphoteric Surfactants having Multiple Hydrophobic and Hydrophilic Groups", U.S. Ser. No. 08/292,993 filed Aug. 19, 1994 wherein a polyamine reactant having at least four amino groups, of which two are terminal primary amine groups, is reacted with an acylating agent such as a carboxylic acid, ester, and the naturally occurring triglyceride esters thereof or acid chlorides thereof in an amount sufficient to provide at least about 1.8 fatty acid groups [$R_1C(O)$-] per polyamine to provide the bisimidazoline.

Also included in the gemini surfactants useful in this invention are those of the formula:

XIV.

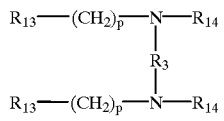

wherein $R_{13}$ is a sugar moiety, e.g., a monosaccharide, desaccharide, or polysaccharide such as glucose; or a polyhydroxy compound such as glycerol; p is independently 0 to 4; $R_3$ is as defined above in formula VII; and $R_{14}$ is a $C_1$–$C_{22}$ alkyl or —$C(O)R_4$ wherein $R_4$ is as described above.

Some of the compounds such as those described above are set forth more fully in U.S. Pat. No. 5,534,197 which description is incorporated herein by reference.

In the compounds used in the invention, many of the moieties can be derived from natural sources which will generally contain mixtures of different saturated and unsaturated carbon chain lengths. The natural sources can be illustrated by coconut oil or similar natural oil sources such as palm kernel oil, palm oil, osya oil, rapeseed oil, castor oil or animal fat sources such as herring oil and beef tallow. Generally, the fatty acids from natural sources in the form of the fatty acid or the triglyceride oil can be a mixture of alkyl radicals containing from about 5 to about 22 carbon atoms. Illustrative of the natural fatty acids are caprylic ($C_8$), capric ($C_{10}$), lauric ($C_{12}$), myristic ($C_{14}$), palmitic ($C_{16}$), stearic ($C_{18}$), oleic ($C_{18}$, monounsaturated), linoleic ($C_{18}$, diunsaturated), linolenic ($C_{18}$, triunsaturated), ricinoleic ($C_{18}$, monounsaturated) arachidic ($C_{20}$), gadolic ($C_{20}$, monounsaturated), behenic ($C_{22}$) and erucic ($C_{22}$). These fatty acids can be used per se, as concentrated cuts or as fractionations of natural source acids. The fatty acids with even numbered carbon chain lengths are given as illustrative though the odd numbered fatty acids can also be used. In addition, single carboxylic acids, e.g., lauric acid, or other cuts, as suited for the particular application, may be used.

Where desired, the surfactants used in the present invention can be oxyalkylated by reacting the product with an alkylene oxide according to known methods, preferably in the presence of an alkaline catalyst. The free hydroxyl groups of the alkoxylated derivative can then be sulfated, phosphated or acylated using normal methods such as sulfation with sulfamic acid or sulfur trioxide-pyridine complex, or acylation with an acylating agent such as a carboxylic acid, ester, and the naturally occurring triglyceride esters thereof.

For alkylation conditions and commonly used alkylating agents, see Amphoteric Surfactants Vol. 12, Ed. B. R. Bluestein and C. L. Hilton, *Surfactant Science Series* 1982, pg. 17 and references cited therein, the disclosures of which are incorporated herein by reference.

For sulfation and phosphation, see Surfactant Science Series, Vol. 7, Part 1, S.Shore & D. Berger, page 135, the disclosure of which is incorporated herein by reference. For phosphating review, see Surfactant Science Series, Vol. 7, Part II, E. Jungermann & H. Silbertman, page 495, the disclosure of which is incorporated herein by reference.

The surfactant compositions of the invention are extremely effective in aqueous solution at low concentrations as defined herein. The surfactants of the invention can be used in any amount needed for a particular application which can be easily determined by a skilled artisan without undue experimentation.

IV. Auxiliary Detergent Ingredients

A. Detergency Builders

Compositions of the present invention may include detergency builders selected from any of the conventional inorganic and organic water-soluble builder salts, including neutral or alkaline salts, as well as various water-insoluble and so-called "seeded" builders.

Builders are preferably selected from the various water-soluble, alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Most preferred are the alkali metal, especially sodium, salts of the above.

Specific examples of inorganic phosphate builders are sodium and potassium tripolyphosphate, pyrophosphate, polymeric metaphate having a degree of polymerization of from about 6 to 21, and orthophosphate. Examples of polyphosphonate builders are the sodium and potassium salts of ethylene-1, 1-diphosphonic acid, the sodium and potassium salts of ethane 1-hydroxy-1, 1-diphosphonic acid and the sodium and potassium salts of ethane, 1,1,2-triphosphonic acid.

Examples of nonphosphorus, inorganic builders are sodium and potassium carbonate, bicarbonate, sesquicarbonate, tetraborate decahydrate, and silicate having a molar ratio of $SIO_2$ to alkali metal oxide of from about 0.5 to about 4.0, preferably from about 1.0 to about 2.4.

Water-soluble, nonphosphorus organic builders useful herein include the various alkali metal, ammonium and substituted ammonium polyacetates, carboxylates, polycarboxylates and polyhyd roxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid.

Highly preferred polycarboxylate builders herein are set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates of U.S. Pat. No. 3,723,322, Diehl incorporated herein by reference.

Other useful builders herein are sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000 for example), and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al.; and U.S. Pat. No. 4,246,495, issued Mar. 27, 1979 to Crutchfield et al., both incorporated herein by reference.

"Insoluble" builders include both seeded builders such as 3:1 weight mixtures of sodium carbonate and calcium carbonate; and 2.7:1 weight mixtures of sodium sesquicarbonate and calcium carbonate. Amphorus and crystalline alumino silicates such as hydrated sodium Zeolite A are commonly used in laundry detergent applications. They have a particle size diameter of 0.1 micron to about 10 microns depending on water content of these molecules. These are referred to as ion exchange materials. Crystalline alumino silicates are characterized by their calcium ion exchange capacity. Amphorus alumino silicates are usually characterized by their magnesium exchange capacity. They can be naturally occurring or synthetically derived.

A detailed listing of suitable detergency builders can be found in U.S. Pat. No. 3,936,537, supra, incorporated herein by reference.

B. Miscellaneous Detergent Ingredients

Detergent composition components may also include hydrotropes, enzymes (e.g., proteases, amylases and cellulases), enzyme stabilizing agents, pH adjusting agents (monoethanolamine, sodium carbonate, etc.) halogen bleaches (e.g., sodium and potassium dichloroisocyanurates), peroxyacid bleaches (e.g., diperoxydodecane-1,12-dioic acid), inorganic percompound bleaches (e.g., sodium perborate), antioxidants as optional stabilizers, reductive agents, activators for percompound bleaches (e.g., tetraacetylethylenediamine and sodium nonanoyloxybenzene sulfonate), is soil suspending agents (e.g., sodium carboxymethyl cellulose), soil anti-redisposition agents, corrosion inhibitors, perfumes and dyes, buffers, whitening agents, solvents (e.g., glycols and aliphatic alcohols) and optical brighteners. Any of other commonly used auxiliary additives such as inorganic salts and common salt, humectants, solubilizing agents, UV absorbers, softeners, chelating agents, static control agents and viscosity modifiers may be added to the detergent compositions of the invention.

For bar compositions, processing aids are optionally used such as salts and/or low molecular weight alcohols such as monodihydric, dihydric (glycol, etc.), trihydric (glycerol, etc.), and polyhydric (polyols) alcohols. Bar compositions may also include insoluble particulate material components, referred to as "fillers" such as calcium carbonate, silica and the like.

V. Composition Concentrations

The amount of the aminosilicone compound used in the compositions and methods of this invention will typically be sufficient to yield a concentration of aminosilicone compound in the washing medium of from about 0.001 to about 0.2 grams of aminosilicone compound per liter of washing medium, more typically from about 0.005 to about 0.1 g/L, and even more typically from about 0.01 to about 0.04 g/L.

In the compositions of the invention, the aminosilicone compound will typically be present in an amount of from about 0.005 to about 30% by weight, more typically from about 1 to about 10% by weight.

The compositions can be in any form that is convenient for use as a detergent, e.g. bars, powders, flakes, pastes, or liquids which may be aqueous or non-aqueous and structured or unstructured. The detergent compositions can be prepared in any manner which is convenient and appropriate to the desired physical form so as co-agglomeration, spray drying, or dispersing in a liquid.

The total weight percentages of the conventional surfactants of the present invention, all weight percentages being based on the total active weight of the compositions of this invention consisting of aminosilicone compound, optional carrier, conventional surfactant(s), gemini surfactant(s), soil release agent(s), and (optionally) detergency builder(s) are about 10 to about 99.9 weight percent, typically about 15–75 weight percent.

The gemini surfactants are typically present, if employed, at a level of about 0.005 to about 50, typically from about 0.02–15.0, active weight percent of the composition.

The polymeric soil release agents, are typically present, if employed, at a level of from about 0.05 to about 40, typically from about 0.2–15 active weight percent.

The optional detergency builders are suitably present at a level of from about 0 to about 70 weight percent, typically from about 5 to about 50 weight percent.

VI. Industrial Applicability

The compositions and methods of this invention can be used to clean various fabrics, e.g. wool, cotton, silk, polyesters, nylon, other synthetics, blends of multiple synthetics and or synthetic/natural fiber blends. The compositions and method are particularly useful with colored fabrics, i.e. those that have a visually perceptible hue. The compositions and methods are also particularly useful in connection with washing media that also contain a fragrance. The fragrance need not be premixed or pre-reacted with the aminosilicone oil in any way nor must the fragrance as an active principle a hydroxy functional compound.

The fragrance substances that may be used in the context of the invention include natural and synthetic fragrances, perfumes, scents, and essences and any other substances and mixtures of liquids and/or powdery compositions which emit a fragrance. As the natural fragrances, there are those of animal origin, such as musk, civet, castreum, ambergris, or the like, and those of vegetable origin, such as lemon oil, rose oil, citronella oil, sandalwood oil, peppermint oil, cinnamon oil, or the like. As synthetic fragrances, there are mixed fragrances of alpha-pinene, limonene, geraniol, linalool, lavandulol, nerolidol, or the like.

VII. Soluble Powder Detergent Compositions Without Inorganic Phosphates

For a good implementation of the invention, said compositions comprise:

from 5 to 60%, preferably from 8 to 40%, of their weight of at least one surface-active agent (S)

from 5 to 80%, preferably from 8 to 40%, of their weight of at least one soluble inorganic or organic builder (B)

from 0.01 to 8%, preferably from 0.1 to 5%, very particularly from 0.3 to 3%, of their weight of at least one aminosilicone (AS).

Mention may be made, among surface-active agents, of the anionic or non-ionic surface-active agents commonly used in the field of detergents for washing laundry, such as anionic surface-active agents, such as:

alkyl ester sulphonates of formula R—CH($SO_3$M)—COOR', where R represents a $C_{8-20}$, preferably $C_{10}$–$C_{16}$, alkyl radical, R' a $C_1$–$C_6$, preferably $C_1$–$C_3$, alkyl radical and M an alkali metal (sodium, potassium or lithium) cation, a substituted or unsubstituted ammonium (methyl-, dimethyl-, trimethyl- or tetramethylammonium, dimethylpiperidinium, and the like) cation or a cation derived from an alkanolamine (monoethanolamine, diethanolamine, triethanolamine, and the like);

alkyl sulphates of formula R$OSO_3$M, where R represents a $C_5$–$C_{24}$, preferably $C_{10}$–$C_{18}$, alkyl or hydroxyalkyl radical, M representing a hydrogen atom or a cation with the same definition as above, and their ethoxylated (EO) and/or propoxylated (PO) derivatives exhibiting an average of 0.5 to 30, preferably of 0.5 to 10, EO and/or PO units;

alkylamide sulphates of formula RCONHR'$OSO_3$M, where R represents a $C_2$–$C_{22}$, preferably $C_6$–$C_{20}$, alkyl radical, R' a $C_2$–$C_3$ alkyl radical, M representing a hydrogen atom or a cation with the same definition as above, and their ethoxylated (EO) and/or propoxylated (PO) derivatives exhibiting an average of 0.5 to 60 EO and/or PO units;

salts of $C_8$–$C_{24}$, preferably $C_{14}$–$C_{20}$, saturated or unsaturated fatty acids, $C_9$–$C_{20}$ alkylbenzenesulphonates, primary or secondary $C_8$–$C_{22}$ alkylsulphonates, alkylglycerol sulphonates, the sulphonated polycarboxylic acids described in GB-A-1,082,179, paraffin sulphonates, N-acyl-N-alkyltaurates, alkyl phosphates, isethionates, alkylsuccinamates, alkylsulphosuccinates, the monoesters or diesters of sulphosuccinates, N-acylsarcosinates, alkylglycoside sulphates or polyethoxycarboxylates the cation being an alkali metal (sodium, potassium or lithium), a substituted or unsubstituted ammonium residue (methyl-, dimethyl-, trimethyl- or tetramethylammonium, dimethylpiperidinium, and the like), or a residue derived from an alkanolamine (monoethanolamine, diethanolamine, triethanolamine, and the like);

sophorolipids, such as those in acid or lactone form, derivatives of 17-hydroxyoctadecenic acid;and the like. non-ionic surface-active agents, such as:

polyoxyalkylenated (polyoxyethylenated, polyoxypropylenated or polyoxybutylenated) alkylphenols, the alkyl substituent of which is $C_6$–$C_{12}$, containing from 5 to 25 oxyalkylene units; mention may be made, by way of example, of Triton X-45, X-114, X-100 or X-102, sold by Rohm & Haas Co., or Igepal NP2 to NP17 from Rhône-Poulenc;

polyoxyalkylenated $C_8$–$C_{22}$ aliphatic alcohols containing from 1 to 25 oxyalkylene (oxyethylene or oxypropylene) units; mention may be made, by way of example, of Tergitol 15-S-9 or Tergitol 24-L-6 NMW, sold by Union Carbide Corp., Neodol 45-9, Neodol 23-65, Neodol 45-7 or Neodol 45-4, sold by Shell Chemical Co., Kyro EOB, sold by The Procter & Gamble Co., Synperonic A3 to A9 from ICI, or Rhodasurf IT, DB and B from Rhône-Poulenc;

the products resulting from the condensation of ethylene oxide or of propylene oxide with propylene glycol or ethylene glycol, with a weight-average molecular mass of the order of 2000 to 10,000, such as the Pluronics sold by BASF;

the products resulting from the condensation of ethylene oxide or of propylene oxide with ethylenediamine, such as the Tetronics sold by BASF;

ethoxylated and/or propoxylated $C_8$–$C_{18}$ fatty acids containing from 5 to 25 oxyethylene and/or oxypropylene units;

$C_8$–$C_{20}$ fatty acid amides containing from 5 to 30 oxyethylene units;

ethoxylated amines containing from 5 to 30 oxyethylene units;

alkoxylated amidoamines containing from 1 to 50, preferably from 1 to 25, very particularly from 2 to 20, oxyalkylene units (preferably oxyethylene units);

amine oxides, such as ($C_{10}$–$C_{18}$ alkyl)dimethylamine oxides or ($C_8$–$C_{22}$ alkoxy)ethyidihydroxyethylamine oxides;

alkoxylated terpene hydrocarbons, such as ethoxylated and/or propoxylated a- or b-pinenes, containing from 1 to 30 oxyethylene and/or oxypropylene units;

the alkylpolyglycosides which can be obtained by condensation (for example by acid catalysis) of glucose with primary fatty alcohols (U.S. Pat. No. 3,598,865, U.S. Pat. No. 4,565,647, EP-A-132,043, EP-A-132, 046, and the like) exhibiting a $C_4$–$C_{20}$, preferably $C_8$–$C_{18}$, alkyl group and a mean number of glucose units of the order of 0.5 to 3, preferably of the order of 1.1 to 1.8, per mole of alkylpolyglycoside (APG); mention may in particular be made of those exhibiting:

a $C_8$–$C_{14}$ alkyl group and, on average, 1.4 glucose units per mole a $C_{12}$–$C_{14}$ alkyl group and, on average, 1.4 glucose units per mole a $C_8$–$C_{14}$ alkyl group and, on average, 1.5 glucose units per mole a $C_8$–$C_{10}$ alkyl group and, on average, 1.6 glucose units per mole sold respectively under the names Glucopon 600 EC®, Glucopon 600 CSUP®, Glucopon 650 EC® and Glucopon 225 CSUP® by Henkel.

Mention may particularly be made, among soluble inorganic builders (B), of:

amorphous or crystalline alkali metal silicates of formula $xSiO_2 \cdot M_2 \cdot yH_2O$, with $1 \leqq x \leqq 3.5$ and $0 \leqq y/(x+1+y) \leqq 0.5$, where M is alkali metal and very particularly sodium, including lamellar alkali metal silicates, such as those described in U.S. Pat. No. 4,664,839;

alkaline carbonates (bicarbonates, sesquicarbonates);

cogranules of hydrated alkali metal silicates and of alkali metal carbonates (sodium or potassium) which are rich in silicon atoms in the Q2 or Q3 form, described in EP-A-488,868; and tetraborates or borate precursors.

Mention may particularly be made, among soluble organic builders (B), of:

water-soluble polyphosphonates (ethane-1-hydroxy-1,1-diphosphonates, salts of methylenediphosphonates, and the like);

water-soluble salts of carboxyl polymers or copolymers, such as the water-soluble salts of polycarboxylic acids with a molecular mass of the order of 2000 to 100,000 obtained by polymerization or copolymerization of ethylenically unsaturated carboxylic acids, such as acrylic acid, maleic acid or anhydride, fumaric acid, itaconic acid, mesaconic acid, citraconic acid or methylenemalonic acid, and very particularly polyacrylates with a molecular mass of the order of 2000 to 10,000 (U.S. Pat. No. 3,308,067) or copolymers of acrylic acid and of maleic anhydride with a molecular mass of the order of 5000 to 75,000 (EP-A-066,915);

polycarboxylate ethers (oxydisuccinic acid and its salts, tartrate monosuccinic acid and its salts, tartrate disuccinic acid and its salts);

hydroxypolycarboxylate ethers;

citric acid and its salts, mellitic acid, succinic acid and their salts;

salts of polyacetic acids (ethylenediaminetetraacetates, nitrilotriacetates, N-(2-hydroxyethyl)nitrilodiacetates);

($C_5$–$C_{20}$ alkyl)succinic acids and their salts (2-dodecenylsuccinates, laurylsuccinates, and the like);

polyacetal carboxylic esters;

polyaspartic acid, polyglutamic acid and their salts;

polyimides derived from the polycondensation of aspartic acid and/or of glutamic acid;

polycarboxymethylated derivatives of glutamic acid (such as N,N-bis(carboxymethyl)glutamic acid and its salts, in particular the sodium salt) or of other amino acids; and aminophosphonates, such as nitrilotris (methylenephosphonate)s.

For a good implementation of the invention, the said aminosilicone (AS) can be chosen from the aminopolyorganosiloxanes (APS) comprising siloxane units of general formulae:

$R^1_aB_bSiO(4-a-b)2$ (I), where a+b=3, with a=0,1,2 or3 and b=0,1,2 or3

$R^1_cA_dSiO(_4c-d)/_2$ (II), where c+d=2, with c=0 or 1 and d=1 or 2

$R^1_2SiO2/2$ (Ill) and optionally $R^1_eA_fSiO(4-e-f/2$ (IV), where e+f=Oor1, withe=Oor1 andf=Oor1 in which formulae, the $R^1$ symbols, which are identical or different, represent a saturated or unsaturated, linear or branched, aliphatic radical containing from 1 to 10 carbon atoms or a phenyl radical, optionally substituted by fluoro or cyano groups;

the A symbols, which are identical or different, represent a primary, secondary, tertiary or quaternized amino group bonded to the silicon via an SiC bond;

the B symbols, which are identical or different, represent an OH functional group;

an OR functional group, where R represents an alkyl group containing from 1 to 12 carbon atoms, preferably from 3 to 6 carbon atoms, very particularly 4 carbon atoms;

an OCOR' functional group, where R' represents an alkyl group containing from 1 to 12 carbon atoms, preferably 1 carbon atom; or the A symbol.

The said aminopolyorganosiloxanes (APS) preferably comprise units of formula (I), (II), (III) and optionally (IV), where in the units of formula (I), a=1, 2 or 3 and b=0 or 1 and in the units of formula (II), c=1 and d=1.

The said A symbol is preferably an amino group of formula $$—R^2—N(R^3)(R^4)$$

where the $R^2$ symbol represents an alkylene group containing from 2 to 6 carbon atoms, which group is optionally substituted or interrupted by one or more nitrogen or oxygen atoms, the $R^3$ and $R^4$ symbols, which are identical or different, represent

H, an alkyl or hydroxyalkyl group containing from 1 to 12 carbon atoms, preferably from 1 to 6 carbon atoms, an aminoalkyl group, preferably a primary aminoalkyl group, the alkyl group of which contains from 1 to 12 carbon atoms, preferably from 1 to 6 carbon atoms, which group is optionally substituted and/or interrupted by at least one nitrogen and/or oxygen atom, the said amino group optionally being quaternized, for example by a hydrohalic acid or an alkyl or aryl halide.

Mention may particularly be made, as example of A symbol, of those of formulae:

$$—(CH_2)_3NH_2;$$

$$—(CH_2)_3NH_3^+X^-;$$

$$—(CH_2)_3N(CH_3)_2;$$

-continued $$—(CH_2)_3N^+(CH_3)_2(C_{18}H_{37})X^-;$$

$$—(CH_2)_3NHCH_2CH_2NH_2;$$

$$—(CH_2)_3N(CH_2CH_2OH)_2; \text{ and}$$

$$—(CH_2)_3N(CH_2CH_2NH_2)_2.$$

Among these, the preferred formulae are:

$$—(CH_2)_3NH_2—(CH_2)_3NHCH_2CH_2NH_2 \text{ and}$$
$$—(CH_2)_3N(CH_2CH_2NH_2)_2.$$

The $R^1$ symbol preferably represent methyl, ethyl, vinyl, phenyl, trifluoropropyl or cyanopropyl groups. It very particularly represents the methyl group (at least predominantly).

The B symbol preferably represents an OR group where R contains from 1 to 6 carbon atoms, very particularly 4 carbon atoms, or the A symbol. The B symbol is very preferably a methyl or butoxy group.

The aminosilicone is preferably at least substantially linear. It is very preferably linear, that is to say does not contain units of formula (IV). It can exhibit a number-average molecular mass of the order of 2000 to 50,000, preferably of the order of 3000 to 30,000.

For a good implementation of the invention, said aminosilicones (AS) or the aminopolyorganosiloxanes (APS) can exhibit in their chain, per total of 100 silicon atoms, from 0.1 to 50, preferably from 0.3 to 10, very particularly from 0.5 to 5, aminofunctionalized silicon atoms.

Insoluble inorganic builders can additionally be present but in a limited amount, in order not to exceed the level of less than 20% of insoluble inorganic material defined above.

Mention may be made, among these adjuvants, of crystalline or amorphous aluminosilicates of alkali metals (sodium or potassium) or of ammonium, such as zeolites A, P, X, and the like.

The said detergent compositions can additionally comprise standard additives for powder detergent compositions, such as soil release agents in amounts of the order of 0.01–10%, preferably of the order of 0.1 to 5% and very particularly of the order of 0.2–3% by weight, agents such as:

- cellulose derivatives, such as cellulose hydroxyethers, methylcellulose, ethylcellulose, hydroxypropyl methylcellulose or hydroxybutyl methylcellulose;
- poly(vinyl ester)s grafted onto polyalkylene stems, such as poly(vinyl acetate)s grafted onto polyoxyethylene stems (EP-A-219,048);
- poly(vinyl alcohol)s;
- polyester copolymers based on ethylene terephthalate and/or propylene terephthalate and polyoxyethylene terephthalate units, with an ethylene terephthalate and/or propylene terephthalate (number of units)/polyoxyethylene terephthalate (number of units) molar ratio of the order of 1/10 to 10/1, preferably of the order of 1/1 to 9/1, the polyoxyethylene terephthalates exhibiting polyoxyethylene units having a molecular weight of the order of 300 to 5000, preferably of the order of 600 to 5000 (U.S. Pat. No. 3,959,230, U.S. Pat. No. 3,893,929, U.S. Pat. No. 4,116,896, U.S. Pat. No. 4,702,857 and U.S. Pat. No. 4,770,666);
- sulphonated polyester oligomers, obtained by sulphonation of an oligomer derived from ethoxylated allyl alcohol, from dimethyl terephthalate and from 1,2-propanediol, exhibiting from 1 to 4 sulphonate groups (U.S. Pat. No. 4,968,451);
- polyester copolymers based on propylene terephthalate and polyoxyethylene terephthalate units which are optionally sulphonated or carboxylated and terminated by ethyl or methyl units (U.S. Pat. No. 4,711,730) or optionally sulphonated polyester oligomers terminated by alkylpolyethoxy groups (U.S. Pat. No. 4,702,857) or anionic sulphopolyethoxy (U.S. Pat. No. 4,721,580) or sulphoaroyl (U.S. Pat. No. 4,877,896) groups;
- sulphonated polyesters with a molecular mass of less than 20,000, obtained from a diester of terephthalic acid, isophthalic acid, a diester of sulphoisophthalic acid and a diol, in particular ethylene glycol (WO 95/32997);
- polyesterpolyurethanes obtained by reaction of a polyester with a number-average molecular mass of 300 to 4000, obtained from adipic acid and/or terephthalic acid and/or sulphoisophthalic acid and a diol, with a prepolymer containing end isocyanate groups obtained from a poly(ethylene glycol) with a molecular mass of 600–4000 and a diisocyanate (FR-A-2,334,698);

anti-redeposition agents, in amounts of approximately 0.01–10% by weight for a powder detergent composition and of approximately 0.01–5% by weight for a liquid detergent composition, agents such as:

- ethoxylated monoamines or polyamines or ethoxylated amine polymers (U.S. Pat. No. 4,597,898, EP-A-011,984);
- carboxymethylcellulose;
- sulphonated polyester oligomers obtained by condensation of isophthalic acid, dimethyl sulphosuccinate and diethylene glycol (FR-A-2,236,926); and
- polyvinylpyrrolidones;

bleaching agents, in an amount of approximately 0.1–20%, preferably 1–10%, of the weight of the said powder detergent composition, such as:

- perborates, such as sodium perborate monohydrate or tetrahydrate;
- peroxygenated compounds, such as sodium carbonate peroxohydrate, pyrophosphate peroxohydrate, urea hydrogen peroxide, sodium peroxide or sodium persulphate;
- percarboxylic acids and their salts (known as "percarbonates", such as magnesium monoperoxyphthalate hexahydrate, magnesium metachloroperbenzoate, 4-nonylamino-4-oxoperoxybutyric acid, 6-nonylamino-6-oxoperoxycaproic acid, diperoxydodecanedioic acid, peroxysuccinic acid nonylamide or decyldiperoxysuccinic acid, preferably in combination with a bleaching activator generating, in situ in the washing liquor, a peroxycarboxylic acid; mention may be made, among these activators, of tetraacetylethylenediamine, tetraacetylmethylenediamine, tetraacetylglycoluril, sodium p-acetoxybenzenesulphonate, pentacetylglucose, octaacetyllactose, and the like;

fluorescence agents, in an amount of approximately 0.05–1.2% by weight, agents such as derivatives of stilbene, pyrazoline, coumarin, fumaric acid, cinnamic acid, azoles, methinecyanines, thiophenes, and the like; foam-suppressant agents, in amounts which can range up to 5% by weight, agents such as:

- $C_{10}$–$C_{24}$ fatty monocarboxylic acids or their alkali metal, ammonium or alkanolamine salts or fatty acid triglycerides;
- saturated or unsaturated, aliphatic, alicyclic, aromatic or heterocyclic hydrocarbons, such as paraffins or waxes;

N-alkylaminotriazines;

monostearyl phosphates or monostearyl alcohol phosphates; and polyorganosiloxane oils or resins, optionally combined with silica particles;

softeners, in amounts of approximately 0.5–10% by weight, agents such as clays (smectites, such as montmorillonite, hectorite or saponite); enzymes, in an amount which can range up to 5 mg by weight, preferably of the order of 0.05–3 mg, of active enzyme/g of detergent composition, enzymes such as proteases, amylases, lipases, cellulases or peroxydases (U.S. Pat. No. 3,553,139, U.S. Pat. No. 4,101,457, U.S. Pat. No. 4,507,219 and U.S. Pat. No. 4,261,868) and other additives, such as:

alcohols (methanol, ethanol, propanol, isopropanol, propanediol, ethylene glycol or glycerol);

buffer agents or fillers, such as sodium sulphate or alkaline earth metal carbonates or bicarbonates; and pigments, the amounts of optional insoluble inorganic additives having to be sufficiently limited in order not to exceed the level of less than 20% of insoluble inorganic materials defined above.

The present invention is further illustrated by the following examples, provided that no observations or other statements made therein should be construed to limit the invention, unless otherwise expressly indicated in the claims appended hereto. All amounts, parts, percentages, and ratios expressed in this specification, including the claims are by weight unless otherwise apparent in context.

EXAMPLES

Washing Procedure

All washes were completed in a washing machine (a US model of Whirlpool Co.) commercially available for household use using an 18 minute regular wash cycle. After each wash, the fabric samples were dried in dryer (a KENMORE brand dryer commercially available from Sears & Roebuck, Co). for household use for 30 minutes on the dryer setting for cotton fabrics.

Tapwater at 80° F. (30 ppm hardness) was used to fill the washing machine. Additional water hardness was added by a Repipet dispenser to deliver 100 ppm of additional hardness for a total washing medium hardness of 130 ppm. The water was agitated to ensure that the final washwater temperature was correct. A powdered or liquid detergent formulation was then added followed at the concentration shown below for each formulation. After agitating the washwater (total 45 L) for 30 seconds, an aminosilicone compound was added to the washing medium to obtain an aminosilicone content in the washwater as shown below. In those instances wherein a clay was added to the washing medium, the aminosilicone compound and a bentonite clay having a high montmorillonite content and a low cristobalite and quartz content was premixed with the silicone compound so as to form an agglomerate. The washwater was then agitated to ensure mixing of the components. Fabric in the form of swatches and/or clothing was added last. The wash was agitated for an additional 30 seconds to ensure wetting of the fabrics and then the wash cycle was reset to 18 minutes and a wash/rinse cycle was completed. The loads were occasionally rotated through four identical washing machines to mitigate an differences in washing activity of the four machines (e.g. speed of agitation). Prior to rotation, the washing machines were thoroughly rinsed. In each wash series, a control wash (i.e. detergent with no aminosilicone additive) was performed. It is noted that in all the examples, all like ingredient abbreviations or designations indicate like ingredients.

Detergent Formulations

The detergent formulations used are set forth below.

Detergent Formulation A:

A non-Phosphate mixed surfactant (anionic and nonionic) Heavy Duty Detergent (HDD) powder sold in the US by USA Detergents as Xtra-Detergent, which contains 10.5% silicate, 12% linear alkylbenzenesulfonate (LAS), 2% nonionic—alcohol ethoxylate, 40% Na carbonate, optical brightener, sodium sulfate, and perfume. This detergent formulation was used at 1.2 g Xtra deter/liter wash water.

Detergent Formulation B:

A phosphate, all anionic HDD powder brand sold by Colgate in Columbia which contains 15% Phosphate (TPP) 25% LAS. 5% Na Silicate, and 30% Na sulfate. This detergent formulation was used at 3 g/L washwater.

Detergent Formulation C:

An anionic/nonionic Super Concentrated Heavy Duty Liquid (⅜ Cup) sold in the US by Lever Bros. as Wisk Liquid which contains LAS, ether sulfate, nonionic—alcohol ethoxylate, citrate, perfume, enzymes, enzyme stabilizer, optical brightener and buffer system. This detergent formulation was used at 1.2 g/L.

Detergent Formulation D:

A non-Phosphate, zeolite-containing Super Concentrated Heavy Duty Detergent (SCHDD) powder mixed nonionic/anionic system sold in the US as Fab Powder in which nonionic:anionic ratio is >1 (for the other liquid and powder detergents: nonionic: anionic ratio is <1) which contains 20% Zeolite, 10% Nonionic surfactant, 2% Anionic surfactant, 30% sodium carbonate, 5% sodium citrate, 0.0–0.3% perfume, 0.0–3% enzymes, 0.2–0.3% brightener. 0.01–2% anti-redeposition agents, and 2–3% polyacrylate. A fragrance (Fresh Floral from International Flavors and Fragrances) was post added: at 0.2% level, detergent was allowed to "age" 1 week at room temperature with occasionally stirring/shaking each day before it was used This detergent formulation was used at 1.0 g/L.

Fabric/Clothing:

The clothing and fabric used were purchased at consumer retail. To ensure uniformity amongst the products tested; the clothing articles were evenly divided amongst the products. For each detergent product 2–4 replicates of each clothing/fabric type are added to the wash. Fabric Types: cotton lycra (95%/5%); corduroy; 100% cotton knit—single and double;100% cotton weave; cotton polyester blends, cotton synthetic blends; cotton terry cloth towels; and flannel. The colors of the clothing and fabrics varied.

Example 1

The general procedure set forth above was accomplished with an aminosilicone compound of formula I wherein $R^1$ and $R^8$ are methoxy, $R^2$, $R^3$, $R^4$, $R^5$, $R^6$, $R^9$, and $R^{10}$ are methyl, $R^7$ is N-aminoethyl-3-aminopropyl, m is about 135, and n is about 1.5 (0.42% Nitrogen; viscosity of 300 m.pa.s). The amount of aminosilicone compound was sufficient to present a concentration of 0.04 g/L of washing medium.

Example 2

The general procedure set forth above was accomplished with an aminosilicone compound of formula I wherein $R^1$ and $R^8$ are methoxy, $R^2$, $R^3$, $R^4$, $R^5$, $R^6$, $R^9$, and $R^{10}$ are methyl, $R^7$ is N-aminoethyl-3-aminopropyl, m is about 135, and n is about 1.5 (0.42% Nitrogen; viscosity of 300 m.pa.s). The amount of aminosilicone compound was sufficient to present a concentration of 0.02 g/L of washing medium.

Example 3

The general procedure set forth above was accomplished with an aminosilicone compound of formula I wherein $R^1$ and $R^8$ are methoxy, $R^2$, $R^3$, $R^4$, $R^5$, $R^6$, $R^9$, and $R^{10}$ are methyl, $R^7$ is N-aminoethyl-3-aminopropyl, m is about 270, and n is about 1.5 (0.21% Nitrogen; viscosity of 1000 m.pa.s). The amount of aminosilicone compound was sufficient to present a concentration of 0.04 g/L of washing medium.

Example 4

The general procedure set forth above was accomplished with an aminosilicone compound of formula I wherein $R^1$ and $R^8$ are methoxy, $R^2$, $R^3$, $R^4$, $R^5$, R6, $R^9$, and $R^{10}$ are methyl,$R^7$ is N-aminoethyl-3-aminopropyl, m is about 270, and n is about 1.5 (0.21% Nitrogen; viscosity of 1000 m.pa.s). The amount of aminosilicone compound was sufficient to present a concentration of 0.02 g/L of washing medium.

Example 5

The general procedure set forth above was accomplished with an aminosilicone compound of formula I wherein $R^1$ and $R^8$ are ethoxy, $R^2$, $R^3$, $R^4$, $R^5$, $R^6$, $R^9$, and $R^{10}$ are methyl, $R^7$ is 3-aminopropyl, m is about 135, and n is about 1.5 (0.21% Nitrogen; viscosity of 300 m.pa.s). The amount of aminosilicone compound was sufficient to present a concentration of 0.04 g/L of washing medium.

Example 6

The general procedure set forth above was accomplished with an aminosilicone compound of formula I wherein $R^1$ and $R^{10}$ are methoxy, $R^2$, $R^3$, $R^4$, $R^5$, $R^6$, $R^9$, and $R^{10}$ are methyl, $R^7$ is 3-aminopropyl, m is about 135, and n is about 1.5 (0.21% Nitrogen; viscosity of 300 m.pa.s). The amount of aminosilicone compound was sufficient to present a concentration of 0.02 g/L of washing medium.

Studies

General Procedure:

A panel comprised of at least 10 experienced evaluators compares the washed swatches/clothing one of which is washed by a control detergent composition and the other of which are washed using a silicone containing "caretergent"identical articles from each of the detergent compositions are evaluated by ranking them. All swatches/clothing articles are evaluated for color protection, brightness/intensity of colors and drape of the cloth. The swatches/clothing articles were also evaluated for softness. Again, in this test, the panelist were asked to rank the products from least to most soft.

Panelist Evaluation of Color Protection, Softness and Drape

Study 1

Washing Medium C had Detergent Formulation C (Wisk Liquid) alone (control).

Washing Medium B had Detergent Formulation C (Wisk Liquid ) plus an aminosilicone not within formula 1 at 0.025 g/L.

Washing Medium A Detergent Formulation C (Wisk Liquid )plus the aminosilicone of Example 1 at 0.07 g/L.

Data:

Number of panelists: 10

Number of different types of swatches evaluated by panelist: 6 highest possible score=60 (5×12)

Results:

Number of swatches washed in A which the panelist ranked as having the best:

color protection: 60 drapability of the cloth: 54 softness: 56

Number of swatches washed in B which the panelist ranked as having the best:

drapability of the cloth: 6 softness: 4 drape: 0 softness: 0

Number of swatches washed in B which the panelist ranked as having the second best:

color protection: 45 drapability: 42 softness: 33

Number of swatches washed in C which the panelist ranked as having the second best:

color protection: 15 drapability: 12 softness: 23

Conclusion

The addition of silicone, particularly, the addition of the silicone of

Example 1 at 0.07 g/L shows significant difference in the aforementioned care benefits when compared to the control, Wisk without silicone additives.

Study 2

Washing Medium C had Detergent Formulation A (X-tra) alone (control).

Washing Medium B had Detergent Formulation A (X-tra) plus the aminosilicone of Example 1 at 0.04 g/L Washing Medium A had Detergent Formulation A (X-tra) plus the aminosilicone of Example 1 0.07 g/L Data:

Part A: Color Protection:

Number of panelists: 12

Number of different types of swatches evaluated by panelist: 5 highest possible score=60 (5×12)

Results:

Number of swatches washed in A which the panelist ranked as having the best:

color protection: 54

Number of swatches washed in B which the panelist ranked as having the best:

color protection: 6

Number of swatches washed in C which the panelist ranked as having the best:

color protection: 0

Number of swatches washed in A which the panelist ranked as having the second best:

color protection: 6

Number of swatches washed in B which the panelist ranked as having the second best:

color protection 54

Number of swatches washed in C which the panelist ranked as having the second best:

color protection 0

Part B Softness—two different types of towels, one fleece type clothing item, sleeve of a corduroy shirt, heavy double knit cotton swatch:

Number of panelists: 12

Number of different types of swatches evaluated by panelist: 5

Highest possible score=60 (5×12)

Results:

Number of swatches washed in A which the panelist ranked as having the best softness: 56

Number of swatches washed in B which the panelist ranked as having the best softness: 4

Number of swatches washed in B which the panelist ranked as having the best softness: 4

Number of swatches washed in A which the panelist ranked as having the second best softness: 4

Number of swatches washed in B which the panelist ranked as having the second best softness: 56

Conclusion:

The addition of silicone to a typical non-P US powder detergent where the silicone concentrations in the washwater ranges from 0.04–0.07 g/L, gives color protection and softness benefits when compared to the powder detergent without additive. At the higher silicone concentration, the softness and color protection benefits are enhanced.

Panelist Evaluation of Fragrance Retention

In the cases where the garments/swatches were washed with detergents containing perfume (Wisk Liquid and US FAB basebead+0.2% perfume), a fragrance retention panel test was also completed. The panelists are asked to determine which bundle of clothing after being dryer-dried smells the most and to describe the fragrance.

Study 1

Washing Medium C had Detergent Formulation C (Wisk Liquid) alone-(control).

Washing Medium A had Detergent Formulation C (Wisk Liquid) plus the aminosilicone of Example 1 at 0.07 g/L.

Data:

Number of panelists: 10

Highest possible vote: 10

Clothing bundle washed and dried 15 times. Panelist evaluated fragrance retention after the 15th dryer drying.

Highest possible score=10

Garments washed in product A smelled the most: 10

Garments washed in product C smelled the most: 0

Study 2

Washing Medium C had Detergent Formulation D (US Fab SCHDD powder) alone (control).

Washing Medium B had Detergent Formulation D (US Fab SCHDD powder) plus the aminosilicone of Example 1 at 0.06 g/L.

Washing Medium A had Detergent Formulation D (US Fab SCHDD powder) plus the aminosilicone of Example 1 at 0.06 g/L 21637 plus 0.15 g/L bentonite clay as described above.

Number of panelists: 11

Highest possible vote: 11

Clothing bundle washed and dried 13 times. Panelist evaluated fragrance retention after the 13th dryer drying.

Garments washed in product A smelled the most: 7

Garments washed in product B smelled the most: 4

Garments washed in product C smelled the most: 0

Conclusion:

Garments washed in a detergent containing silicone showed significant fragrance retention over detergent alone. Despite the fact that the presence of clay in a detergent formula may sometimes require the use of higher fragrance concentration to overcome the absorptive nature of the clay filler, the addition of clay to the above detergent/silicone system did significantly alter the fragrance retention benefit. The garments washed in the detergent powder containing clay silicone were determined by the panelists to give more fragrance retention than the detergent without any additives.

Panelist Evaluation of Static Control

Static control is determined right after the clothes are dried for the specific time. The panelists are asked to pull out specific swatches from the dryer and assess the clinginess/static buildup of the specific swatch to the rest of the clothing bundle, and to the dryer wall itself. In the latter case the swatch is placed on the inside vertical portion of the dryer wall; its ability to drop off the wall is observed. The static control of the swatches for each of the products are ranked from most to least "clingy"/static. In this case "ties" were allowed.

Study 1

Washing Medium C had Detergent Formulation B (Colombian Fab HDD powder) alone (control)

Washing Medium B had Detergent Formulation B (Colombian Fab) plus the aminosilicone of Example 1 at 0.06 g/L Washing Medium A had Detergent Formulation B(Colombian Fab) plus the aminosilicone of Example 1 at 0.06 g/L plus 0.3 g/L bentonite clay as described above.

Number of panelists: 5

Clothing bundle washed and dried 10 times. Panelists evaluated the static control Most static, most dinginess—C: 5 votes Least static, least dinginess—B equal to A: 5 votes Soluble Powder Detergents Without Inorganic Phosphates Examples 7 and 8

Two examples of detergent compositions according to the invention appear in the appended Table.

The aminosilicone employed is the aminopolydimethylsiloxane of formula:

$$MeO—Si(Me)_2—O—[Si(Me)_2—O]_x—[Si(Me)(A)—O]_y—Si(Me)_2OMe$$

where x is equal to 135 and y to 1.5

A represents the $—(CH_2)_3—NH—(CH_2)_2—NH_2$ group

Me represents the methyl group

TABLE

| Constituents | Formulation A | Formulation B |
|---|---|---|
| Zeolite 4A | 17 | 15 |
| Nabion silicate/carbonate cogranule | 0 | 30 |
| Silicate, $2SiO_2.Na_2O$ | 13 | 0 |
| Sodium carbonate | 15 | 0 |
| Acrylate/maleate copolymer Sokalan CP5 | 5 | 5 |
| Sodium sulphate | 8.5 | 8.5 |
| CMC, Blanose 7MXF | 1 | 1 |
| Perborate monohydrate | 15 | 15 |
| TAED granule | 5 | 5 |
| Anionic surfactant LABS Nansa | 6 | 6 |
| Non-ionic surfactant, Synperonic A3 (3EO ethoxylated alcohol) | 3 | 3 |
| Non-ionic surfactant, Synperonic A9 (9EO ethoxylated alcohol) | 9 | 9 |
| Enzymes (esperases, amylases, cellulase, protease) | 0.5 | 0.5 |
| Aminosilicone | 2.0 | 2.0 |

What is claimed is:

1. A method comprising washing a colored fabric article in a washing medium comprised of a major amount by weight of water, a first minor amount by weight of a detergent and a second minor amount by weight of an aminosilicone compound having the formula:

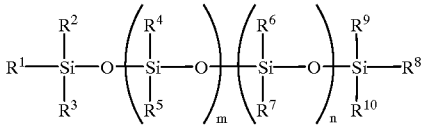

wherein:

$R^1$ and $R^8$ are independently selected from the group consisting of hydrogen, hydroxyl, alkyl and alkoxy, $R^2$, $R^3$, $R^9$, and $R^{10}$ are independently selected from the group consisting of alkyl, and alkoxy, provided that one of $R^2$, $R^3$, $R^9$, and $R^{10}$ may be selected from the group consisting of a primary amino-substituted alkyl group, a secondary amino-substituted alkyl group and an N-(amino-alkyl)-substituted aminoalkyl group having both primary and secondary amine functionality, $R^4$, $R^5$, and $R^6$ are independently selected from the group consisting of alkyl and aryl, $R^7$ is selected from the group consisting of a primary amino-substituted alkyl group, a secondary amino-substituted alkyl group and an amino-alkyl-substituted alkyl group having both primary and secondary amine functionality, and m and n are numbers wherein m is greater than n and the sum of n and m yield an aminosilicone compound with a viscosity of 10 to 100,000 cps at 25°, wherein said first minor amount by weight is greater than said second minor amount by weight.

2. A method as claimed in claim 1, wherein said washing medium is the product of mixing water with a composition comprised of said aminosilicone compound in association with an insoluble support.

3. A method as claimed in claim 1, wherein $R^1$ and $R^8$ are each alkoxy.

4. A method as claimed in claim 1, wherein said washing is repeated successively with at least about ten successive washing media and wherein said washing medium is effective to prevent fading of the color of said fabric after said washings.

5. A method as claimed in claim 1, wherein $R^1$ and $R^8$ are each alkoxy.

6. A method as claimed in claim 1, wherein said washing medium is effective to prolong the release of said fragrance from said fabric article after said washing.

7. A detergent composition comprising a major amount by weight of a detergent and a first minor amount by weight of an aminosilicone compound having the formula:

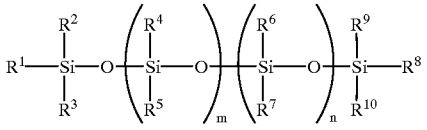

wherein:

$R^1$ and $R^8$ are independently alkoxy, $R^2$, $R^3$, $R^9$, and $R^{10}$ are independently selected from the group consisting of alkyl, and alkoxy, provided that one of $R^2$, $R^3$, $R^9$, and $R^{10}$ may be selected from the group consisting of a primary amino-substituted alkyl group, a secondary amino-substituted alkyl group and an N-(amino-alkyl)-substituted aminoalkyl group having both primary and secondary amine functionality), $R^4$, $R^5$, and $R^6$ are independently selected from the group consisting of alkyl and aryl, $R^7$ is selected from the group consisting of a primary amino-substituted alkyl group, and a secondary amino-substituted alkyl group, and m and n are numbers wherein m is greater than n and the sum of n and m yield an aminosilicone compound with a viscosity of 10 to 100,000 cps at 25°, and a second minor amount by weight of an insoluble support, wherein said aminosilicone compound is in association with said insoluble support.

8. A powder detergent composition of claim 7, without inorganic phosphates, further comprising:

at least one surface-active agent (S)

at least one inorganic or organic builder (B) which is soluble in the washing liquor said composition comprising at most 20% by weight of inorganic substances which are insoluble in the washing liquor.

9. A composition according to claim 8, comprising:

from 5 to 60% of their weight of at least one surface-active agent;

from 5 to 80% of their weight of at least one soluble inorganic or organic builder (B);

from 0.01 to 8%, of their weight of at least one aminosilicone (AS).

10. A detergent composition, without inorganic phosphates, comprising:

at least one surface-active agent (S), at least one inorganic or organic builder (B) which is soluble in the washing liquor, said composition comprising at most 20% by weight of inorganic substances which are insoluble in the washing liquor, and an aminosilicone chosen from the aminopolyorganosiloxanes comprising siloxane units of general formulae:

$$R^1_aB_bSiO_{(4-a-b)/2} \quad \text{(I)},$$

where a+b=3, with a=0,1,2 or 3 and b=0, 1, 2 or 3

$$R^1_cA_dSiO_{(4-a-d)/2} \quad \text{(II)},$$

where c+d=2, with c=0 or 1 and d=1 or 2

$$R^1_2SiO_{2/2} \quad \text{(III)},$$

and optionally $$R^1_eA_fSiO_{(4-a-f)/2} \quad \text{(IV)},$$

where e+f=0 or 1, with e=0 or 1 and f=0 or 1 in which formulae, the $R^1$ symbols, which are identical or different, represent a saturated or unsaturated, linear or branched, aliphatic radical containing from 1 to 10 carbon atoms or a phenyl radical, optionally substituted by fluoro or cyano groups;

the A symbols, which are identical or different, represent a primary, secondary, tertiary or quaternized amino group bonded to the silicon via an SiC bond;

the B symbols, which are identical or different, represent an OH functional group;

an OR functional group, where R represents an alkyl group containing from 1 to 12 carbon atoms;

an OCOR' functional group, where R' represents an alkyl group containing from 1 to 12 carbon atoms; or the A symbol.

11. A detergent composition according to claim wherein 10 in the units of formula (I), a=1, 2 or 3 and b=0 or 1, and in the units of formula (II), c=1 and d=1.

12. A detergent composition according to claim 10 wherein said A symbol is an amino group of formula:

$$—R^2—N(R^3)(R^4)$$

where the $R^2$ symbol represents an alkylene group containing from 2 to 6 carbon atoms, which group is optionally substituted or interrupted by one or more nitrogen or oxygen atoms, the $R^3$ and $R^4$ symbols, which are identical or different, represent

H, an alkyl or hydroxyalkyl group containing from 1 to 12 carbon atoms, or an aminoalkyl group the alkyl group of which contains from 1 to 12 carbon atoms, which group is optionally substituted and/or interrupted by at least one nitrogen and/or oxygen atom, said amino group optionally being quatemized.

13. A detergent composition according to claim 10, wherein A symbol has the formula $—(CH_2)_3NH_2$;

$—(CH_2)_3N(CH_3)_2$;

$—(CH_2)_3NHCH_2CH_2NH_2$;

$—(CH_2)_3NH_3^+X^-$;

$—(CH_2)_3N^+(CH_3)_2(C_{18}H_{37})$ X;

$—(CH_2)_3N(CH_2CH_2OH)_2$; or $—(CH_2)_3N(CH_2CH_2NH_2)_2$.

14. A detergent composition according to claim 10, wherein the $R^1$ symbol represents a methyl, ethyl, vinyl, phenyl, trifluoropropyl or cyanopropyl group, very particularly the methyl group.

15. A detergent composition according to claim 10, wherein the B symbol represents:

an OR group, where R contains from 1 to 6 carbon atoms, or the A symbol.

16. A detergent composition according to claim 8, wherein said aminosilicone is linear.

17. A detergent composition according to claim 8, wherein said aminosilicone exhibits a number-average molecular mass of the order of 2000 to 50,000.

18. A detergent composition according to claim 8, wherein said aminosilicone exhibits in its chain, per total of 100 silicon atoms, from 0.1 to 50 aminofunctionalized silicon atoms.

19. A detergent composition according to claim 8, wherein said surface-active agent is anionic or non-ionic.

20. A detergent composition according to claim 8, wherein said soluble inorganic or organic builder (B) is chosen from:

amorphous or crystalline alkali metal silicates of formula: $xSiO_2 \cdot M_2O \cdot yH_2O$, with $1 \leqq x \leqq 3.5$ and $0 \leqq y/(x+1+y) \leqq 0.5$, where M is an alkali metal and very particularly sodium, including lamellar alkali metal silicates;

alkaline carbonates;

cogranules of hydrated alkali metal silicates and of alkali metal carbonates;

tetraborates or borate precursors;

water-soluble polyphosphonates;

water-soluble salts of carboxyl polymers or copolymers with a molecular mass of the order of 2000to 100,000;

polycarboxylate ethers;

hydroxypolycarboxylate ethers;

citric acid and its salts, mellitic acid, succinic acid and their salts;

salts of polyacetic acids;

($C_5$–$C_{20}$ alkyl)succinic acids and their salts;

polyacetal carboxylic esters;

polyaspartic acid, polyglutamic acid and their salts;

polyimides derived from the polycondensation of aspartic acid and/or of glutamic acid;

polycarboxymethylated derivatives of glutamic acid; and aminophosphonates.

21. Process for protecting textiles, in particular colored textiles, by washing the said textiles using an aqueous liquor containing water and an effective amount of the detergent composition of claim 8 for cleaning said textiles during said washing.

22. Process according to claim 21, wherein said aqueous liquor contains of the order of 0.5 to 10 grams/liter of said detergent composition.

23. Process according to claim 21, wherein said washing is carried out at a temperature of the order of 25 to 90° C.

24. A method comprising washing a colored fabric article in a washing medium comprised of a major amount by weight of water, a first minor amount by weight of a detergent and a second minor amount by weight of an aminosilicone compound chosen from the aminopolyorganosiloxanes comprising siloxane units of general formulae:

$$R^1_aB_bSiO_{(4-a-b)/2} \quad \text{(I)},$$

where a+b=3, with a=0,1,2 or 3 and b=0, 1, 2 or3, $$R^1_cA_dSiO_{(4-a-d)/2} \quad \text{(II)},$$

where c+d=2, with c=0 or 1 and d=1 or 2, $$R^1_2SiO_{2/2} \quad \text{(III)},$$

and optionally $$R^1_eA_fSiO_{(4-a-f)/2} \quad \text{(IV)},$$

where e+f=0 or 1, with e=0 or 1 and f=0 or 1 in which formulae, the $R^1$ symbols, which are identical or different, represent a saturated or unsaturated, linear or branched, aliphatic radical containing from 1 to 10 carbon atoms or a phenyl radical, optionally substituted by fluoro or cyano groups;

the A symbols, which are identical or different, represent a primary, secondary, tertiary or quatemized amino group bonded to the silicon via an SiC bond;

the B symbols, which are identical or different, represent an OH functional group an OR functional group, where R represents an alkyl group containing from 1 to 12 carbon atoms, an OCOR' functional group, where R represents an alkyl group containing from 1 to 12 carbon atoms the A symbol.

25. A method as claimed in claim 1, wherein $R^7$ is an N-(amino-alkyl)-substituted aminoalkyl group.

26. A method as claimed in claim 1, wherein $R^7$ is N-(amino-ethyl)-3-aminopropyl.

27. A method as claimed in claim 1, wherein:

$R^1$ and $R^8$ are independently selected from the group consisting of hydrogen, hydroxyl, $C_1$–$C_4$ alkyl and $C_1$–$C_4$ alkoxy, $R^2$, $R^3$, $R^9$, and $R^{10}$ are independently selected from the group consisting of $C_1$–$C_4$ alkyl, and $C_1$–$C_4$ alkoxy, provided that one of $R^2$, $R^3$, $R^9$, and $R^{10}$ may be an N-(amino-alkyl)-substituted aminoalkyl group having both primary and secondary amine functionality, $R^4$, $R^5$, and $R^6$ are independently selected from the group consisting of $C_1$–$C_4$ alkyl and phenyl, $R^7$ is an amino-alkyl-substituted alkyl group having both primary and secondary amine functionality, and m and n are numbers wherein the ratio of m:n is from about 2:1 to about 500:1, and the sum of n and m yield an aminosilicone compound with a viscosity of 10 to 100,000 cps at 25°, wherein said first minor amount by weight is greater than said second minor amount by weight.

28. A method as claimed in claims 27, wherein the ratio of m:n is from about 40:1 to about 300:1 and the sum of n and m is from about 10 to about 600.

29. A method as claimed in claim 28, wherein the ratio of m:n is from about 85:1 to about 185:1 and the sum of n and m is from about 50 to about 400.

30. A method as claimed in claim 29, wherein the sum of n and m is from about 135 to about 275.

31. A composition as claimed in claim 7, wherein:

$R^1$ and $R^8$ are independently selected from the group consisting of hydrogen, hydroxyl, $C_1$–$C_4$ alkyl and $C_1$–$C_4$ alkoxy, $R^2$, $R^3$, $R^9$, and $R^{10}$ are independently selected from the group consisting of $C_1$–$C_4$ alkyl, and $C_1$–$C_4$ alkoxy, provided that one of $R^2$, $R^3$, $R^9$, and $R^{10}$ may be an N-(amino-alkyl)-substituted aminoalkyl group having both primary and secondary amine functionality, $R^4$, $R^5$, and $R^6$ are independently selected from the group consisting of $C_1$–$C_4$ alkyl and phenyl, $R^7$ is an amino-alkyl-substituted alkyl group having both primary and secondary amine functionality, and m and n are numbers wherein the ratio of m:n is from about 2:1 to about 500:1, and the sum of n and m yield an aminosilicone compound with a viscosity of 10 to 100,000 cps at 25°, wherein said first minor amount by weight is greater than said second minor amount by weight.

32. A composition as claimed in claim 31, wherein the ratio of m:n is from about 40:1 to about 300:1 and the sum of n and m is from about 10 to about 600.

33. A composition as claimed in claim 32, wherein the ratio of m:n is from about 85:1 to about 185:1 and the sum of n and m is from about 50 to about 400.

34. A composition as claimed in claim 33, wherein the sum of n and m is from about 135 to about 275.

35. A composition according to claim 9, comprising:

from 8 to 40% of their weight of at least one surface-active agent;

from 8 to 40% of their weight of at least one soluble inorganic or organic builder (B);

from 0.1 to 5% of their weight of at least one aminosilicone (AS).

36. A composition according to claim 35, comprising from 0.3 to 3% of their weight of at least one aminosilicone (AS).

37. A detergent composition according to claim 10, wherein said aminosilicone is chosen from the aminopolyorganosiloxanes comprising siloxane units of general formulae:

$$R^1_aB_bSiO_{(4-a-b)/2} \quad \text{(I)},$$

where a+b=3, with a=0,1,2 or 3 and b=0, 1, 2 or 3

$$R^1_cA_dSiO_{(4-c-d)/2} \quad \text{(II)},$$

where c+d=2, with c=0 or 1 and d=1 or 2

$$R^1_2SiO_{2/2} \quad \text{(III)}$$

and optionally $$R^1_eA_fSiO_{(4-e-f)/2} \quad \text{(IV)},$$

where e+f=0 or 1, with e=0 or 1 and f=0 or 1 in which formulae, the $R^1$ symbols, which are identical or different, represent a saturated or unsaturated, linear or branched, aliphatic radical containing from 1 to 10 carbon atoms or a phenyl radical, optionally substituted by fluoro or cyano groups;

the A symbols, which are identical or different, represent a primary, secondary, tertiary or quatemized amino group bonded to the silicon via an SiC bond;

the B symbols, which are identical or different, represent an OH functional group;

an OR functional group, where R represents an alkyl group containing from 3 to 6 carbon atoms;

an OCOR' functional group, where R' represents an alkyl group containing 1 carbon atom; or the A symbol.

38. A detergent composition according to claim 10, wherein said A symbol is an amino group of formula:

$$—R^2—N(R^3)(R^4)$$

where the $R^2$ symbol represents an alkylene group containing from 2 to 6 carbon atoms, which group is optionally substituted or interrupted by one or more nitrogen or oxygen atoms, the $R^3$ and $R^4$ symbols, which are identical or different, represent

H, an alkyl or hydroxyalkyl group containing from 1 to 6 carbon atoms, or a primary aminoalkyl group, the alkyl group of which contains from 1 to 12 carbon atoms, which group is optionally substituted and/or interrupted by at least one nitrogen and/or oxygen atom, said amino group optionally being quatemized.

39. A detergent composition according to claim 38, wherein in said primary aminoalkyl group, the alkyl group of which contains from 1 to 6 carbon atoms.

40. A detergent composition according to claim 10, wherein the B symbol represents:

an OR group, where R contains 4 carbon atoms, or the A symbol.

41. A detergent composition according to claim 8, wherein said aminosilicone exhibits a number-average molecular mass of the order of 3000 to 30,000.

42. A detergent composition according to claim 8, wherein said aminosilicone exhibits in its chain, per total of 100 silicon atoms, from 0.3 to 10 aminofunctionalized silicon atoms.

43. A detergent composition according to claim 8, wherein said aminosilicone exhibits in its chain, per total of 100 silicon atoms, from 0.5 to 5 aminofunctionalized silicon atoms.

44. A method according to claim 24, wherein said aminosilicone compound is chosen from the aminopolyorganosiloxanes comprising siloxane units of general formulae:

$$R^1_aB_bSiO_{(4-a-b)/2} \quad \text{(I)},$$

where a+b=3, with a=0,1,2 or 3 and b=0, 1, 2 or 3

$$R^1_cA_dSiO_{(4-c-d)/2} \quad \text{(II)},$$

where c+d=2, with c=0 or 1 and d=1 or 2

$$R^1_2SiO_{2/2} \quad \text{(III)},$$

and optionally $$R^1_eA_fSiO_{(4-e-f)/2} \quad \text{(IV)},$$

where e+f=0 or 1, with e=0 or 1 and f=0 or 1 in which formulae, the $R^1$ symbols, which are identical or different, represent a saturated or unsaturated, linear or branched, aliphatic radical containing from 1 to 10 carbon atoms or a phenyl radical, optionally substituted by fluoro or cyano groups;

the A symbols, which are identical or different, represent a primary, secondary, tertiary or quaternized amino group bonded to the silicon via an SiC bond;

the B symbols, which are identical or different, represent an OH functional group an OCOR' functional group, where R' represents an alkyl group containing 1 carbon atom the A symbol.

45. A method according to claim 24, wherein the B symbol represents:

an OR group, where R contains 4 carbon atoms, or the A symbol.

46. A method according to claim 1, wherein the $R^1$ and $R^8$ are independently selected from the group consisting of hydrogen, hydroxy and $C_1$–$C_1$ alkyl and $R^2$, $R^3$, $R^9$ and $R^{10}$ are independently selected from the group consisting of $C_1$–$C_1$ alkyl, provided that one of $R^2$, $R^3$, $R^9$, and $R^{10}$ may be selected from the group consisting of a primary amino-substituted alkyl group, a secondary amino-substituted alkyl group and an N-(amino-alkyl)-substituted aminoalkyl group having both primary and secondary amine functionality.

47. A method according to claim 1, wherein the $R^1$ and $R^8$ are independently selected from the group consisting of hydrogen, hydroxy, methoxy and $C_1$—$C_1$ alkyl and $R^2$, $R^3$, $R^9$ and $R^{10}$ are independently selected from the group consisting of methoxy and $C_1$–$C_1$ alkyl, provided that one of $R^2$, $R^3$, $R^9$, and $R^{10}$ may be selected from the group consisting of a primary amino-substituted alkyl group, a secondary amino-substituted alkyl group and an N-(amino-alkyl)-substituted aminoalkyl group having both primary and secondary amine functionality.

* * * * *